US007712684B2

(12) United States Patent
Masuda et al.

(10) Patent No.: US 7,712,684 B2
(45) Date of Patent: May 11, 2010

(54) FUEL INJECTION VALVE

(75) Inventors: Ryo Masuda, Nagoya (JP); Kiyomi Kawamura, Nisshin (JP); Makoto Nagaoka, Nagoya (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 458 days.

(21) Appl. No.: 11/300,365

(22) Filed: Dec. 15, 2005

(65) Prior Publication Data

US 2006/0131447 A1 Jun. 22, 2006

(30) Foreign Application Priority Data

Dec. 20, 2004 (JP) ..... 2001-368558

(51) Int. Cl.

| | |
|---|---|
| ***F02M 61/00*** | (2006.01) |
| *B05B 1/32* | (2006.01) |
| *B05B 1/26* | (2006.01) |
| *B05B 1/14* | (2006.01) |
| *F02M 61/10* | (2006.01) |
| *F02M 61/08* | (2006.01) |

(52) U.S. Cl. ..... 239/533.12; 239/453; 239/499; 239/500; 239/502; 239/504; 239/533.7; 239/533.11; 239/590.5

(58) Field of Classification Search ..... 239/533.12, 239/533.11, 499, 500, 502, 504, 453, 533.7, 239/590.5

See application file for complete search history.

(56) References Cited

U.S. PATENT DOCUMENTS 2,743,962 A * 5/1956 Dressler ..... 239/453
2,753,217 A * 7/1956 Pccora, Jr. et al. ..... 239/453
3,022,954 A * 2/1962 Webster et al. ..... 239/453
3,159,349 A * 12/1964 Crocco et al. ..... 239/453
3,183,664 A * 5/1965 Divone ..... 239/265.35
3,205,656 A * 9/1965 Elverum, Jr. ..... 239/416.4
3,361,353 A * 1/1968 Millman ..... 239/5

(Continued)

FOREIGN PATENT DOCUMENTS

EP 1 312796 A2 5/2003

(Continued)

OTHER PUBLICATIONS

N. Tamaki, et al., "Atomization Enhancement of the Spray and Improvement of the Spray Characteristics by Cavitation and Pin Inserted in the Nozzle Hole", Proceedings of the 9th International Conference on Liquid Atomization and Spray Systems- ICLASS 2003, ISBN88-88104-03-8, Jul. 13-17, 2003; 12 pages.

*Primary Examiner*—Dinh Q Nguyen
*Assistant Examiner*—Steven Cernoch
(74) *Attorney, Agent, or Firm*—Oblon, Spivak, McClelland, Maier & Neustadt, L.L.P.

(57) ABSTRACT

A fuel injection valve which injects fuel from a nozzle hole includes a cavitation generation flow path in which a cavitation bubble is generated in fuel flowing inside the injection valve, and a bubble storage flow path which is connected to the cavitation generation flow path and the nozzle hole and which stores the cavitation bubble generated in the cavitation generation flow path. A fuel containing the cavitation bubble stored in the bubble storage flow path is injected from the nozzle hole so that atomization of an injected fuel spray is enhanced.

10 Claims, 19 Drawing Sheets

U.S. PATENT DOCUMENTS

| | | | | |
|---|---|---|---|---|
| 5,662,277 | A * | 9/1997 | Taubitz et al. | 239/585.4 |
| 5,743,470 | A * | 4/1998 | Schlaf et al. | 239/533.4 |
| 5,758,829 | A * | 6/1998 | Itoh et al. | 239/533.2 |
| 6,189,817 | B1 * | 2/2001 | Lambert | 239/533.2 |
| 6,244,525 | B1 * | 6/2001 | Gallup et al. | 239/533.12 |
| 6,283,389 | B1 * | 9/2001 | Hofmann | 239/533.11 |
| 6,354,514 | B1 * | 3/2002 | Henricson et al. | 239/128 |
| 6,357,677 | B1 * | 3/2002 | Ren et al. | 239/585.4 |
| 6,588,678 | B1 * | 7/2003 | Mattes | 239/102.2 |
| 6,729,563 | B2 | 5/2004 | Peterson, Jr. | |
| 6,742,727 | B1 | 6/2004 | Peterson, Jr. | |
| 6,786,423 | B2 | 9/2004 | Peterson, Jr. | |
| 6,817,545 | B2 | 11/2004 | Xu | |
| 7,044,407 | B2 * | 5/2006 | Fischer et al. | 239/533.7 |
| 7,059,549 | B2 | 6/2006 | Xu | |
| 7,137,576 | B2 | 11/2006 | Xu | |
| 2002/0130193 | A1 | 9/2002 | Peterson, Jr. | |
| 2003/0057300 | A1 | 3/2003 | Peterson, Jr. | |
| 2003/0127540 | A1 | 7/2003 | Xu | |
| 2004/0004139 | A1 * | 1/2004 | Fischer et al. | 239/584 |
| 2004/0195390 | A1 | 10/2004 | Peterson, Jr. | |
| 2004/0245356 | A1 * | 12/2004 | Kondratiev et al. | 239/589 |
| 2005/0023380 | A1 | 2/2005 | Xu | |
| 2005/0023381 | A1 | 2/2005 | Xu | |

FOREIGN PATENT DOCUMENTS

| | | |
|---|---|---|
| JP | 60-142051 | 7/1985 |
| JP | 1-174566 | 12/1989 |
| JP | 2001-182641 | 7/2001 |
| JP | 2002-4983 | 1/2002 |
| JP | 2003-83205 | 3/2003 |
| JP | 2003-184706 | 7/2003 |
| JP | 2003-206828 | 7/2003 |
| JP | 2004-19481 | 1/2004 |
| JP | 2004-316598 | 11/2004 |

* cited by examiner

A–A CROSS SECTION

A–A CROSS SECTION

FUEL INJECTION VALVE

The entire disclosure of Japanese Patent Application No. 2004-368558 including specification, claims, drawings and abstract is incorporated herein by reference.

BACKGROUND OF THE INVENTION

1. Field of the Invention

The present invention relates to a fuel injection valve which injects a fuel from a nozzle hole, and more particularly to a fuel injection valve which generates a cavitation bubble in fuel flowing inside an injection valve.

2. Description of the Related Art

Fuel injection valves which generate cavitation bubbles in fuel flowing inside an injection valve in order to enhance atomization in a fuel spray have been proposed. Japanese Patent Laid-Open Publication No. 2003-83205, Japanese Patent Laid-Open Publication No. 2004-19481, and N. Tamaki et al., "Atomization Enhancement of the Spray and Improvement of the Spray Characteristics by Cavitation and Pin Inserted in the Nozzle Hole", ICLASS, 2003 describe related art of such a structure. The fuel injection valve of Japanese Patent Laid-Open Publication No. 2003-83205 has a cavitation generator which generates cavitation bubbles in the fuel and a cavitation eliminator which eliminates the cavitation bubbles generated by the cavitation generator. In the fuel injection valve of this reference, disturbance is caused in the fuel flow within the nozzle hole by an impact pressure which is generated during disappearance of the cavitation bubbles to enhance atomization of the fuel spray.

In a fuel injection valve according to Japanese Patent Laid-Open Publication No. 2004-19481, the nozzle hole is separated into a first nozzle hole portion on the upstream side and a second nozzle hole portion on the downstream side. By setting the cross sectional area of the second nozzle hole portion to be larger than the cross sectional area of the first nozzle hole portion, a storage portion which stores the fuel is formed between the inner wall of the second nozzle hole portion and the fuel jet flowing from the first nozzle hole portion. Cavitation bubbles are generated within a shearing layer which is created by a velocity difference between the fuel stored in the storage portion and the fuel jet flowing from the first nozzle hole portion. In this manner, cavitation bubbles are formed near an outer peripheral surface of the fuel jet and the energy when the cavitation bubbles collapse is used for atomization of the fuel spray.

In the fuel injection valve of N. Tamaki et al., the nozzle hole is configured so that a gap portion is provided between an upstream nozzle hole and a downstream nozzle hole. Cavitation bubbles generated by the upstream nozzle hole collapse in the gap portion due to attenuation of the fuel flow and recovery of pressure. In addition, because a projecting pin is provided inside the nozzle hole, the cavitation bubbles also collapse in the downstream nozzle hole. A disturbance is caused in the fuel flow within the nozzle hole by the collapse of the cavitation bubbles so that the atomization in the fuel spray is enhanced.

In order to effectively achieve the atomization enhancement effect of the fuel spray by cavitation collapse over the entire region of the fuel jet after injection, it is desirable to inject fuel in which the cavitation bubbles are uniformly mixed (or mixed in an approximate uniform manner) from the nozzle hole.

In the fuel injection valves of Japanese Patent Laid-Open Publication No. 2003-83205 and N. Tamaki et al., because the cavitation bubbles disappear within the injection valve, only the fuel in liquid from is present in the fuel jet downstream of the exit of the nozzle hole. Therefore, the atomization enhancement effect of the fuel spray by the cavitation collapse cannot be obtained in the fuel jet after injection.

In the fuel injection valve of Japanese Patent Laid-Open Publication No. 2004-19481, although fuel in which the cavitation is mixed can be injected from the nozzle hole, the formation region of the cavitation bubbles is limited to a region near an outer peripheral surface of the fuel jet and a core of liquid phase remains around the center of the fuel jet. Because of this, the atomization enhancement effect of the fuel spray by the cavitation collapse cannot be obtained in a wide area in the fuel jet after injection.

SUMMARY OF THE INVENTION

The present invention advantageously provides a fuel injection valve which can further enhance atomization in a fuel spray which is injected.

According to one aspect of the present invention, there is provided a fuel injection valve which injects fuel from a nozzle hole, comprising a cavitation generation flow path in which a cavitation bubble is generated in fuel flowing inside the injection valve, and a bubble storage flow path which is connected to the cavitation generation flow path and the nozzle hole and which stores the cavitation bubble generated in the cavitation generation flow path. The fuel injection valve according to the present invention injects, from the nozzle hole, fuel containing the cavitation bubble stored in the bubble storage flow path.

In the present invention, cavitation bubbles are generated in the cavitation generation flow path, stored in the bubble storage flow path, and mixed with fuel of liquid phase and the fuel is introduced to the nozzle hole. As a result, fuel in a mixture state of gas and liquid can be injected from the nozzle hole. Therefore, according to the present invention, the atomization enhancement effect in the fuel spray due to collapse of cavitation can be effectively obtained over the entire region of the fuel jet after the injection, and consequently, the atomization of the injected fuel spray can be further enhanced.

According to another aspect of the present invention, it is preferable that, in the fuel injection valve, an exit which connects the bubble storage flow path and the nozzle hole is provided in the bubble storage flow path, and the bubble storage flow path is connected to the cavitation generation flow path and the nozzle hole while the exit to the nozzle hole is offset with respect to a direction of a fuel jet flowing in the cavitation generation flow path. With this structure, it is possible to inhibit flowing of the fuel jet from the cavitation generation flow path to the nozzle hole without any process in the bubble storage flow path.

According to another aspect of the present invention, it is preferable that, in the fuel injection valve, the fuel is injected from the nozzle hole while a cross sectional area of the bubble storage flow path is larger than a cross sectional area of the cavitation generation flow path. With this structure, a vertical vortex can be formed within the bubble storage flow path so that the cavitation bubble can be stored around the center of the vortex having a lower pressure than the surroundings.

According to another aspect of the present invention, it is preferable that, in the fuel injection valve, the fuel is injected from the nozzle hole while a cross sectional area of the nozzle hole is larger than a cross sectional area of the cavitation generation flow path. With this structure, the cavitation bubbles can effectively be generated in the fuel jet flowing into the bubble storage flow path.

According to another aspect of the present invention, it is preferable that, in the fuel injection valve, a cross sectional area of an entrance portion of the cavitation generation flow path is gradually reduced toward the bubble storage flow path. With this structure, because a discharge coefficient of the cavitation generation flow path can be increased, a number of generated cavitation bubbles can be increased in the fuel jet entering the bubble storage flow path.

According to another aspect of the present invention, it is preferable that, in the fuel injection valve, a cross sectional area of the cavitation generation flow path is reduced toward the bubble storage flow path. With this structure, because the discharge coefficient in the cavitation generation flow path can be increased, the number of generated cavitation bubbles can be increased in the fuel jet entering the bubble storage flow path.

According to another aspect of the present invention, it is preferable that, in the fuel injection valve, a wall which forms a part of the bubble storage flow path is provided, an exit which connects the bubble storage flow path and the nozzle hole is provided in the bubble storage flow path, and the wall has a curved surface which curves from a region which approximately opposes a fuel jet flowing in the cavitation generation flow path to the exit to the nozzle hole. With this structure, disappearance of the cavitation bubbles in the bubble storage flow path can be inhibited.

According to another aspect of the present invention, it is preferable that, in the fuel injection valve, a swirl generation flow path in which a swirl flow is generated in fuel flowing inside the injection valve is formed upstream of the cavitation generation flow path or in the cavitation generation flow path. With this structure, it is possible to alleviate non-uniformity in the flow rate distribution along a circumferential direction of the injection valve.

BRIEF DESCRIPTION OF THE DRAWINGS

A preferred embodiment of the present invention will be described in detail by reference to the drawings, wherein.

DESCRIPTION OF THE PREFERRED EMBODIMENT

Figure 1:
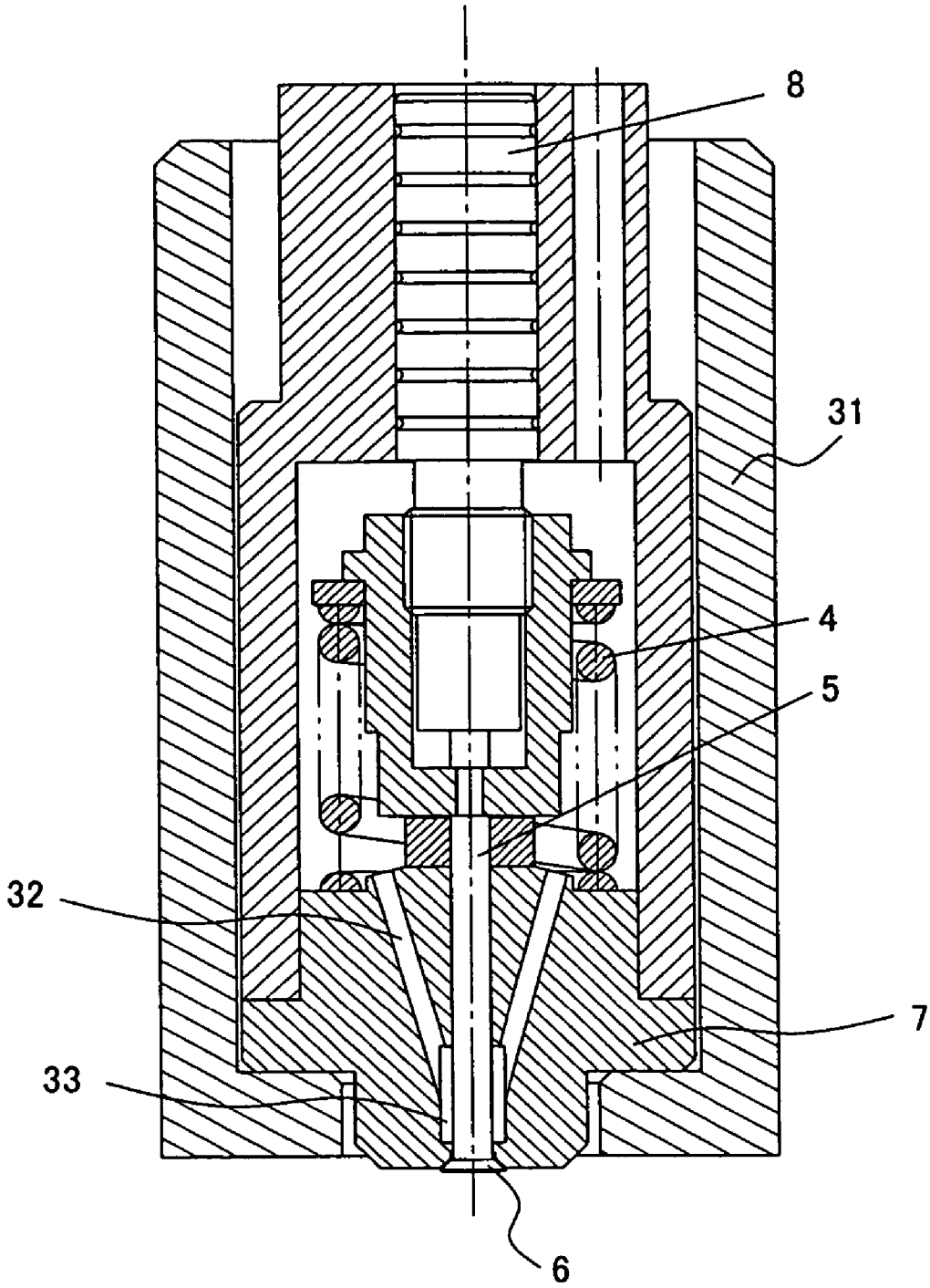
FIG. 1 is a diagram schematically showing an internal structure of a fuel injection valve according to a preferred embodiment of the present invention.
Figure 2:
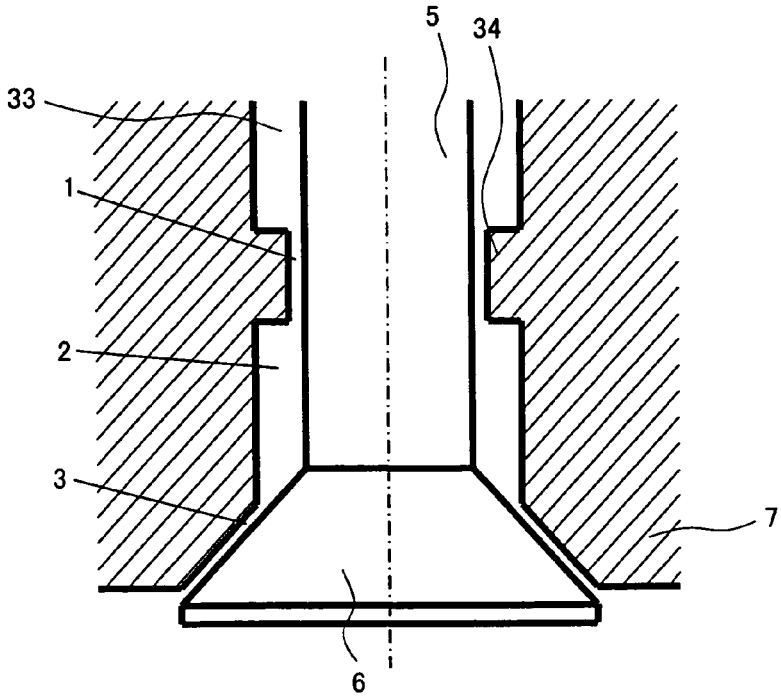
FIG. 2 is a diagram schematically showing a structure of a tip of a nozzle body of a fuel injection valve according to a preferred embodiment of the present invention.

A preferred embodiment of the present invention will now be described. FIGS. 1 and 2 are diagrams schematically showing a structure of a fuel injection valve according to a preferred embodiment of the present invention. FIG. 1 shows an internal structure of the fuel injection valve and FIG. 2 schematically shows a structure of a tip of a nozzle body. A fuel injection valve of the present embodiment is a fuel injection valve of an externally open valve type and used in, for example, internal combustion engines.

A nozzle body 7 is provided inside a valve housing 31. A nozzle hole 3 is formed on a tip of the nozzle body 7. A pintle 5 is inserted in a hollow portion formed in the central portion of the nozzle body 7 and is supported in a slidable state along an inner peripheral surface of the nozzle body 7. One end of the pintle 5 is connected to a plunger 8 and a poppet valve 6 is provided on the other end of the pintle 5. A biasing force toward the plunger 8 (toward the top of FIG. 1) due to a spring 4 acts on the pintle 5.

Fuel supplied in a pressurized manner by a fuel pump (not shown) flows into a fuel storage portion through a fuel supply flow path 32 formed in the nozzle body 7. When a piezo-actuator (not shown) is not driven, because the pintle 5 is biased toward the plunger 8 (toward the top of FIG. 1) by the spring 4, the poppet valve 6 is in contact with a seat portion of the nozzle body 7 and the nozzle hole 3 is closed (valve closure state). In this configuration, the fuel is not injected from the nozzle hole 3. When, on the other hand, the piezo-actuator is driven, a driving force toward the nozzle hole 3 (toward the bottom of FIG. 1) acts on the plunger 8 and the pintle 5 is driven toward the nozzle hole 3 (toward the bottom of FIG. 1). Because of this, the poppet valve 6 is separated from the seat portion of the nozzle body 7 and the nozzle hole 3 is opened (valve open state). In this case, fuel stored in the fuel storage portion 33 is injected from the nozzle hole 3.

In the present embodiment, cavitation bubbles are generated in fuel flowing inside the nozzle body 7 when the fuel is injected. For this purpose, a projection 34 which projects toward the pintle 5 is formed on an inner peripheral surface of the nozzle body 7 at a position downstream of a fuel storage portion 33 so that a cavitation generation flow path 1 for generating cavitation bubbles is formed downstream of the fuel storage portion 33. Because of this projection 34, a cross sectional area of the flow path is stepwise reduced (rapid reduction) in transition from the fuel storage portion 33 to the cavitation generation flow path 1 and the cross sectional area of the flow path is stepwise increased (rapid expansion) in transition from the cavitation generation flow path 1 to a downstream flow path.

In addition, in the present embodiment, a bubble storage flow path 2 which stores the cavitation bubbles is formed downstream of the cavitation generation flow path 1 in order to inhibit disappearance of the cavitation bubbles generated in the cavitation generation flow path 1. The bubble storage flow path 2 is connected to the cavitation generation flow path 1 at its entrance and to the nozzle hole 3 at its exit. A cross sectional area of the bubble storage flow path 2 (minimum cross sectional area) is larger than a cross sectional area of the cavitation generation flow path 1 (minimum cross sectional area). In addition, the exit of the bubble storage flow path 2 is provided at a position offset toward the external side along a radial direction of the injection valve with respect to a direction of the fuel jet flowing in the cavitation generation flow path 1. In other words, at a position opposing the fuel jet flowing in the cavitation generation flow path 1, the exit of the bubble storage flow path 2 is not provided and a wall of the bubble storage flow path 2 (an outer peripheral surface of the poppet valve 6) is formed.

In the structure of FIG. 2, the cross sectional area of the bubble storage flow path 2 is rapidly enlarged toward the external side along the radial direction of the injection valve, from the cross sectional area of the cavitation generation flow path 1. In the bubble storage flow path 2, while an entrance from the cavitation generation flow path 1 is placed at an inner peripheral side (a side near the pintle 5), the exit to the nozzle hole 3 is provided at an outer peripheral side (a side near the nozzle body 7). An angle of the nozzle hole 3 is set so that the direction of the fuel jet flowing in the nozzle hole 3 is tilted with respect to the direction of fuel jet flowing in the cavitation generation flow path 1.

An operation of the fuel injection valve according to the present embodiment will now be described.

Figure 3:
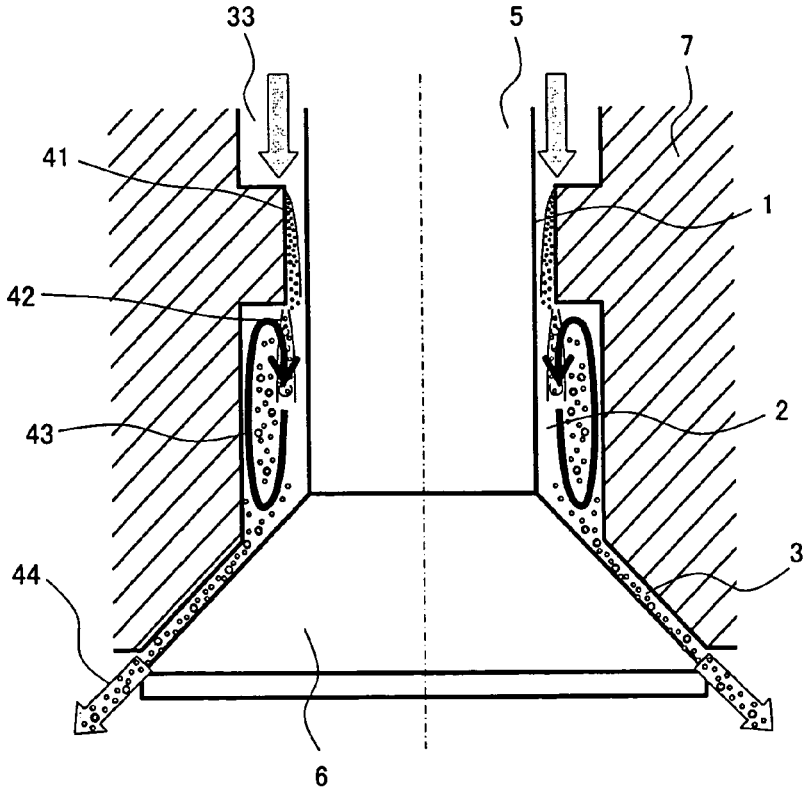
FIG. 3 is a diagram for explaining an operation of a fuel injection valve according to a preferred embodiment of the present invention.

In a valve closure state in which the nozzle hole 3 is closed, the inside of the injection valve is filled with fuel in a liquid phase. When the piezo-actuator is driven from this state to open the nozzle hole 3, a pressure of the bubble storage flow path 2 is gradually reduced due to formation of a flow field of the fuel and a pressure differential is created between the entrance and exit of the cavitation generation flow path 1. Because of the creation of the pressure differential, cavitation bubbles start to be generated from a vertex portion of the entrance of the cavitation generation flow path 1 (vertex portion of the projection 34), as shown in FIG. 3. When the pressure differential is further increased, cavitation bubbles also start to be generated in a shearing layer between the fuel jet flowing out of the exit of the cavitation generation flow path 1 and the fuel surrounding the fuel jet, as shown in FIG. 3. FIG. 3 shows a cavitation 41 generated at the entrance of the cavitation generation flow path 1 and a cavitation 42 generated in the shearing layer downstream of the exit of the cavitation generation flow path 1.

In the present embodiment, the cross sectional area of the bubble storage flow path 2 (minimum cross sectional area) is set to be larger than the cross sectional area of the cavitation generation flow path 1 (minimum cross sectional area), to achieve a rapid-expansion flow at the exit of the cavitation generation flow path 1, so that a vertical vortex 43 is formed in the bubble storage flow path 2 and cavitation bubbles are stored around the center of the vortex which has a lower pressure than the surroundings. The cavitation bubbles are also generated at the central portion of the vertical vortex 43. In addition, in order to form a strong vertical vortex 43 in the bubble storage flow path 2, the exit of the bubble storage flow path 2 to the nozzle hole 3 is offset with respect to the direction of the flow jet flowing in the cavitation generation flow path 1 so that flow of the fuel jet from the cavitation generation flow path 1 to the nozzle hole 3 without any processing is inhibited.

The fuel liquid of the bubble storage flow path 2 and the cavitation bubbles are mixed and introduced to the nozzle hole 3 and fuel in a state of mixture of gas and liquid is injected from the nozzle hole 3 as shown by an arrow 44 in FIG. 3. In the structure of FIG. 2, because the cross sectional area of the flow path is rapidly enlarged toward an external side along the radial direction of the injection valve in the transition from the cavitation generation flow path 1 to the bubble storage flow path 2, a vortex is formed at an outer peripheral side of the bubble storage flow path 2. Because of this, in the bubble storage flow path 2, the void fraction (volume fraction) of the cavitation bubbles becomes relatively larger at the outer peripheral side than an inner peripheral side. By placing the exit to the nozzle hole 3 at the outer peripheral side of the bubble storage flow path 2, it is possible to introduce a fuel flow containing a large amount of cavitation bubbles to the nozzle hole 3.

Next, an experimental result and a result of a numerical analysis performed by the present inventors will be described.

Cavitation number Cn in the cavitation generation flow path 1 is defined by the following formula (1). In formula (1), P1 represents a pressure of the fuel storage portion 33 (injection setting pressure), P2 represents a pressure of the bubble storage flow path 2 (average pressure), and Pv represents a saturated vapor pressure of the fuel (saturated vapor pressure at a usage temperature).

$$Cn=(P1-P2)/(P2-Pv) \quad (1)$$

Figure 4A:
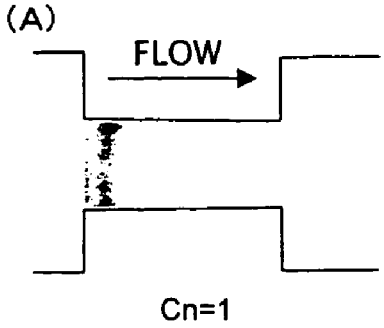
FIG. 4A is a diagram of an experimental result of an experiment with the flow visualized, showing a generation state of cavitation bubbles.
Figure 4B:
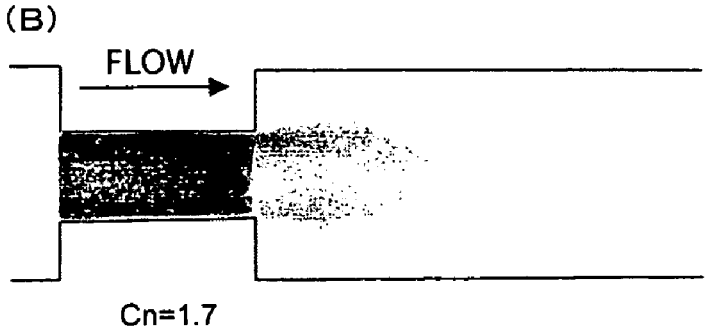
FIG. 4B is a diagram of an experimental result of an experiment with the flow visualized, showing a generation state of cavitation bubbles.
Figure 4C:
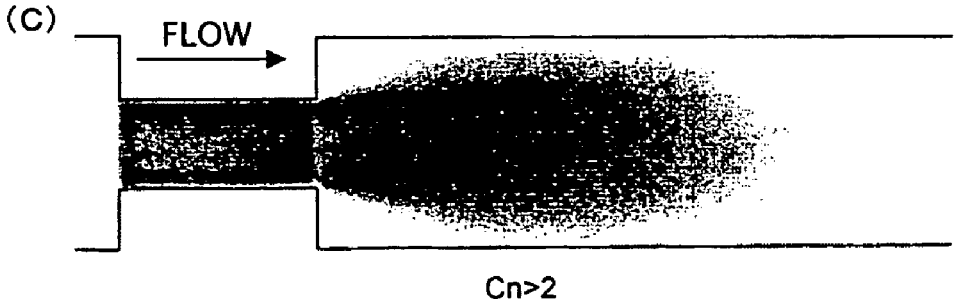
FIG. 4C is a diagram of an experimental result of an experiment with the flow visualized, showing a generation state of cavitation bubbles.

Regarding liquids flowing through a nozzle in which the cross sectional area of the flow path is rapidly reduced at the entrance and rapidly enlarged at the exit, generation of cavitation bubbles were examined through a visualization experiment of the flow. FIGS. 4A, 4B, and 4C show the experimental results. When the pressure differential between the entrance and exit of the nozzle is increased to gradually increase the cavitation number Cn, cavitation bubbles start to be generated from the vertex portion of the entrance of the nozzle around cavitation number Cn of approximately 1, as shown in FIG. 4A. When the pressure differential is further increased to further increase the cavitation number Cn, the cavitation bubbles also start to be generated in a shearing layer between a jet from the exit of the nozzle and liquid surrounding the jet around cavitation number Cn of greater than or equal to approximately 1.7 as shown in FIGS. 4B and 4C. In order to effectively generate the cavitation bubbles by the cavitation generation flow path 1, it is preferable that the cavitation number Cn defined by the formula (1) be 1.7 or greater.

When the discharge coefficient of the cavitation generation flow path 1 is C1 (determined based on the shape of the cavitation generation flow path 1), the discharge coefficient of the nozzle hole 3 is C2 (determined based on the shape of the nozzle hole 3), the cross sectional area (minimum cross sectional area) of the cavitation generation flow path 1 is A1, the cross sectional area (minimum cross sectional area) of the nozzle hole 3 during fuel is injected is A2, the environmental pressure in which the fuel is injected is Pa, and the density of the fuel is p, the following formula (2) can be derived from an equation of continuity.

$$q = c_1 \cdot A_1 \cdot \sqrt{2 \cdot \frac{P1 - P2}{\rho}} = c_2 \cdot A_2 \cdot \sqrt{2 \cdot \frac{P2 - Pa}{\rho}} \quad (2)$$

The formula (2) can be converted to another form to obtain the following formula (3).

$$P2 = \frac{P1 \cdot \left(\frac{c_1 \cdot A_1}{c_2 \cdot A_2}\right)^2 + Pa}{1 + \left(\frac{c_1 \cdot A_1}{c_2 \cdot A_2}\right)^2} \quad (3)$$

The formula (3) shows that the pressure (average pressure) P2 of the bubble storage flow path 2 can be adjusted by a ratio A1/A2 of the cross sectional areas of the flow paths between the cavitation generation flow path 1 and the nozzle hole 3. Therefore, the cavitation number Cn can be adjusted by the ratio A1/A2 of cross sectional areas of flow paths. Thus, it is preferable that the pressure (injection setting pressure) P1 of the fuel storage portion 33 and the ratio A1/A2 of the cross sectional areas of flow paths between the cavitation generation flow path 1 and the nozzle hole 3 be set so that the cavitation number Cn calculated using the formula (1) is 1.7 or greater. For this purpose, at least the full-lift amount of the poppet valve 6 must be set so that fuel is injected from the nozzle hole 3 while the cross sectional area (minimum cross sectional area) A2 of the nozzle hole 3 is greater than the cross sectional area (minimum cross sectional area) A1 of the cavitation generation flow path 1.

Figure 5:
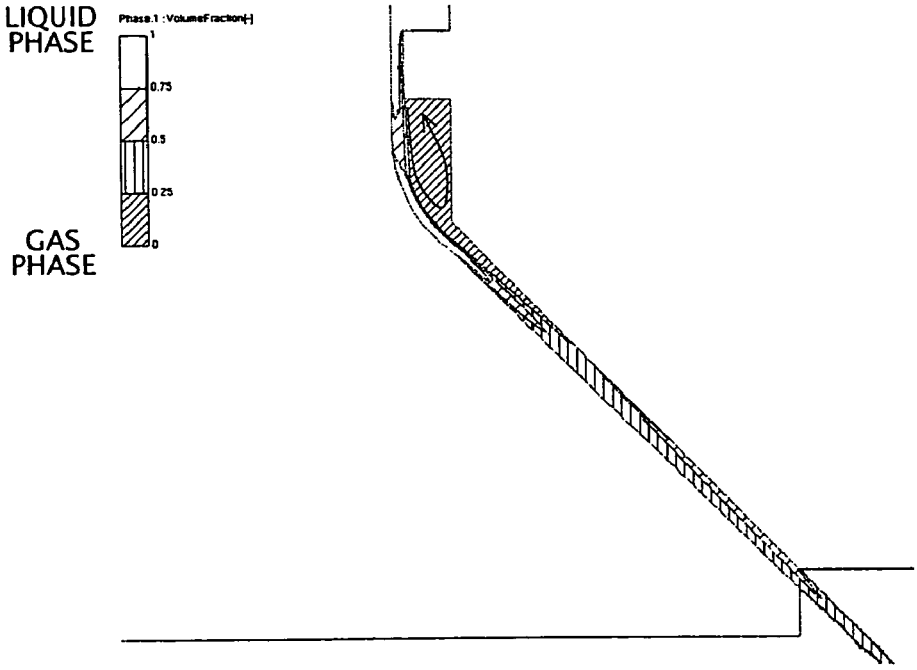
FIG. 5 is a diagram showing a result of a numerical analysis of a void fraction (volume fraction) of bubbles.

FIG. 5 shows a result of a numerical analysis of void fraction (volume fraction) of the bubbles under the conditions of the injection setting pressure P1 of 12 MPa, the environmental pressure Pa of 1.2 MPa, the ratio A1/A2 of cross sectional areas of flow paths during injection of 0.5, an exit width x of the cavitation generation flow path 1 of 25 μm, and a length y of the bubble storage flow path 2 of 250 μm. As shown in FIG. 5, fuel in a state of mixture of gas and liquid can be injected from the nozzle hole 3 within 0.1 ms after the injection is started. In addition, the void fraction of the bubbles at the exit of the nozzle hole 3 is approximately 0.5 in the steady state of the full-lift of the poppet valve 6, and it is thus confirmed by the numerical analysis that the fuel in which gas and liquid are almost uniformly mixed is injected from the nozzle hole 3.

Figure 6:
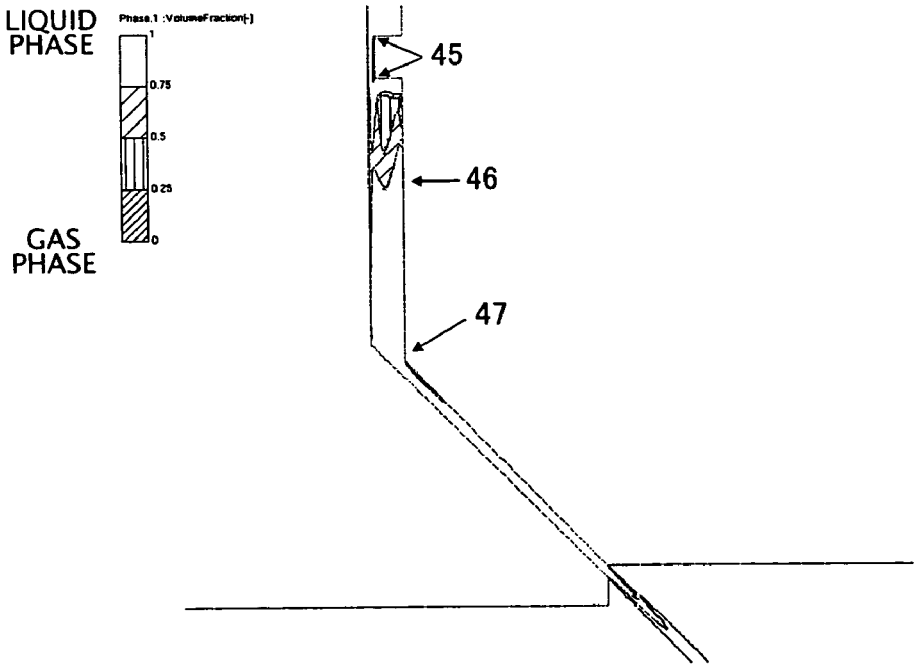
FIG. 6 is a diagram showing a result of a numerical analysis of a void fraction (volume fraction) of bubbles.

FIG. 6 shows a result of a numerical analysis of the void fraction (volume fraction) of the bubbles when the length y of the bubble storage flow path 2 is changed to 1000 μm. As shown in FIG. 6, when the length y of the bubble storage flow path 2 becomes extremely long, although cavitation bubbles are generated in the cavitation generation flow path 1 (refer to an arrow 45), the bubbles collapse inside the bubble storage flow path 2 (refer to an arrow 46), and the fuel is introduced to the nozzle hole 3 in a state of liquid phase (refer to an arrow 47). Therefore, the length y of the bubble storage flow path 2 is preferably set to a value small enough so that the bubbles do not collapse inside the bubble storage flow path 2.

As described, in the present embodiment, the cavitation bubbles generated in the cavitation generation flow path 1 are not collapsed inside the injection valve, are temporarily stored in the bubble storage flow path 2, and are mixed with a fuel of liquid phase, and the mixture is introduced to the nozzle hole 3. In this manner, the fuel can be injected from the nozzle hole 3 in a state of mixture of gas and liquid, and thus, the atomization enhancement effect of the fuel spray by collapse of cavitation can effectively be obtained over the entire region of the fuel jet after injection. Therefore, the atomization of the injected fuel spray can be further enhanced. In addition, a spray penetration force can be reduced without losing the atomization enhancement effect due to the collapse of cavitation, and consequently, occurrence of adhesion of the fuel to a wall can be reduced.

In the present embodiment, by setting the flow in the transition from the cavitation generation flow path 1 to the bubble storage flow path 2 to the rapid expansion flow, a vertical vortex can be formed in the bubble storage flow path 2 and the cavitation bubbles can be stored around the center of the vortex which has a lower pressure than the surrounding. In addition, by offsetting the exit of the bubble storage flow path 2 to the nozzle hole 3 with respect to the direction of the fuel jet flowing in the cavitation generation flow path 1, a strong vertical vortex can be formed in the bubble storage flow path 2 and exiting of the fuel jet from the cavitation generation flow path 1 to the nozzle hole 3 without any processing in the bubble storage flow path 2 can be inhibited.

In the present embodiment, by injecting the fuel from the nozzle hole 3 while the cross sectional area A2 of the nozzle hole 3 is larger than the cross sectional area A1 of the flow path of the cavitation generation flow path 1, the cavitation bubbles can be effectively generated. Moreover, by setting the pressure (injection setting pressure) P1 of the fuel storage portion 33 and the ratio A1/A2 of the cross sectional areas of the flow paths so that the cavitation number Cn calculated by the formula (1) is 1.7 or greater, the cavitation bubbles can be more effectively generated.

Another configuration of the present embodiment will now be described.

Figure 7:
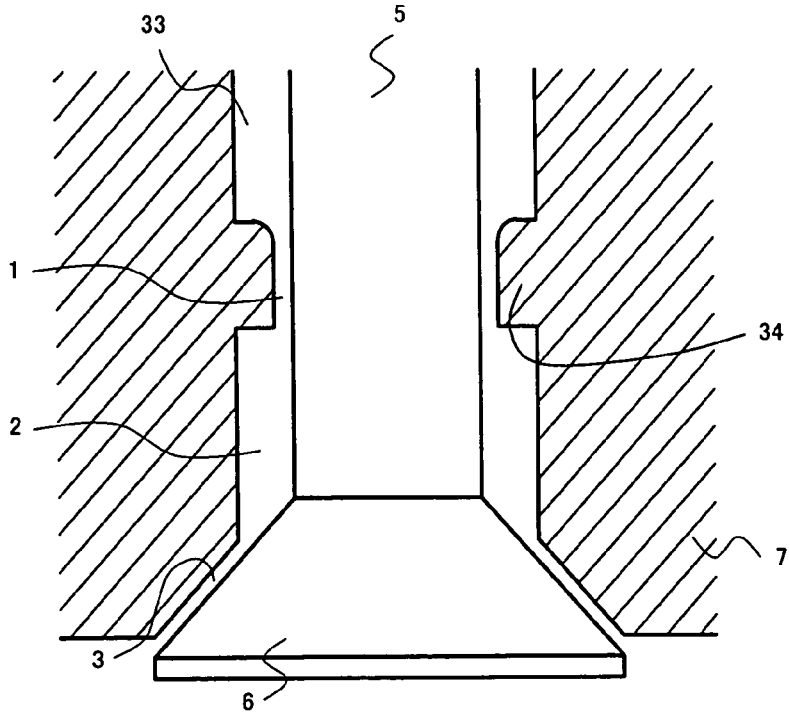
FIG. 7 is a diagram schematically showing another structure of a tip of a nozzle body.

In a configuration of the tip of the nozzle body as shown in FIG. 7, a curved surface having a predetermined radius is formed at an upstream vertex portion of the projection 34 so that the cross sectional area of the flow path at the entrance portion of the cavitation generation flow path 1 is gradually reduced toward the bubble storage flow path 2. With this structure, because the discharge coefficient of the cavitation generation flow path 1 can be increased, the velocity of the fuel jet flowing out from the exit of the cavitation generation flow path 1 can be increased. Therefore, because generation of the cavitation bubbles in the shearing layer between the fuel jet flowing out from the exit of the cavitation generation flow path 1 and the fuel surrounding the fuel jet can be promoted, the atomization in the fuel spray by the collapse of the cavitation in the injected fuel jet can be further enhanced.

Figure 8:
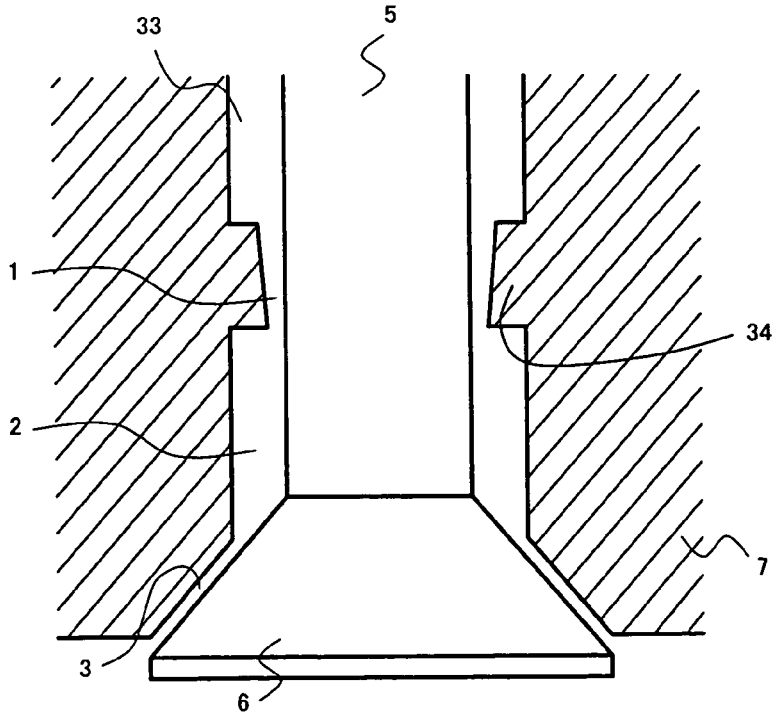
FIG. 8 is a diagram schematically showing another structure of a tip of a nozzle body.
Figure 9:
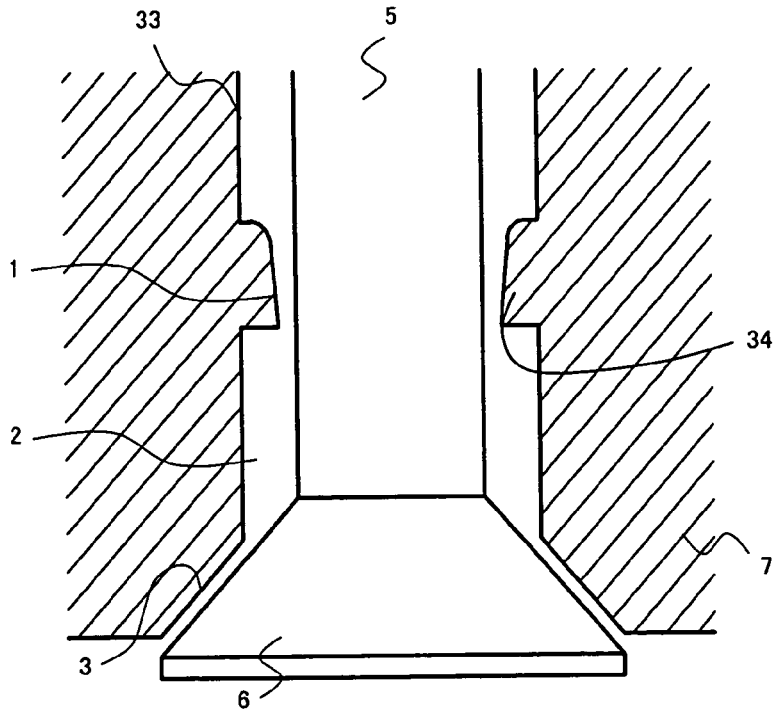
FIG. 9 is a diagram schematically showing another structure of a tip of a nozzle body.

In the configuration of the tip of the nozzle body as shown in FIG. 8, a tapered shape is employed as the shape of the side wall of the outer periphery of the cavitation generation flow path 1 so that the cross sectional area of the cavitation generation flow path 1 becomes smaller toward the bubble storage flow path 2. With this configuration also, because the discharge coefficient of the cavitation generation flow path 1 can be increased, generation of the cavitation bubbles in the shearing layer between the fuel jet flowing out of the exit of the cavitation generation flow path 1 and the fuel surrounding the fuel jet can be promoted. FIG. 9 shows a configuration of the tip of the nozzle body in which the structures shown in FIGS. 7 and 8 are combined.

Figure 10:
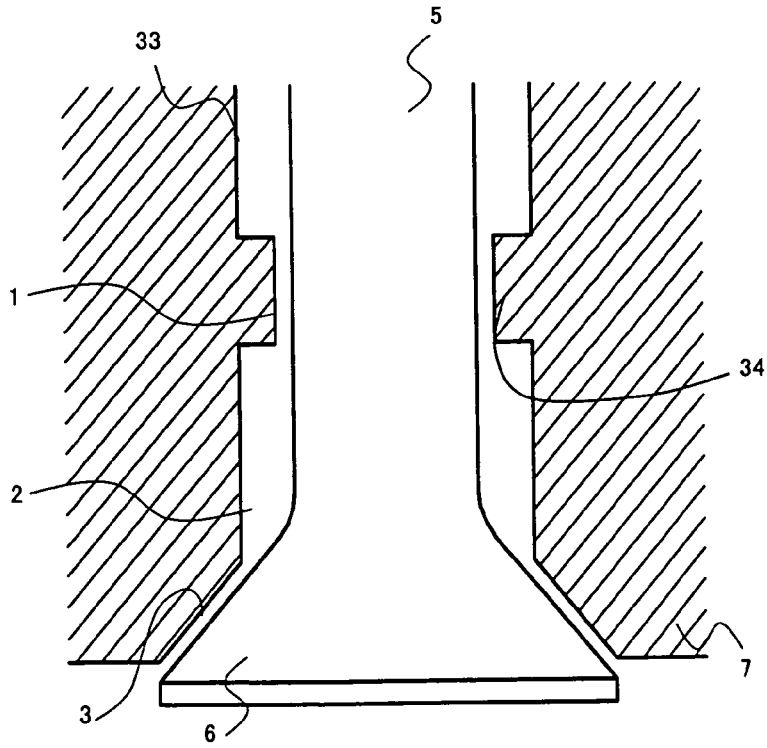
FIG. 10 is a diagram schematically showing another structure of a tip of a nozzle body.

In the configuration of the tip of the nozzle body as shown in FIG. 10, a slope having a curved shape is formed at a boundary between the pintle 5 and the poppet valve 6 so that the shape of the wall forming a part of the bubble storage flow path 2 includes a curved surface shape which is curved from a region which approximately opposes the fuel jet flowing in the cavitation generation flow path 1 to the exit to the nozzle hole 3. When the fuel jet to which the cavitation bubbles are mixed collides with the wall of the bubble storage flow path 2, the gas phase is again liquefied due to an increase in the pressure. Thus, a curved surface shape which is bowed toward the outside of the bubble storage flow path 2 is employed as the shape of the wall of the bubble storage flow path 2 from the region to which the fuel jet collides to the exit to the nozzle hole 3, so that the direction of flow of the fuel is smoothly changed and the liquefaction of the gas phase can be inhibited. Therefore, the atomization of the fuel spray by collapse of cavitation in the injected fuel jet can be further enhanced. A result of a numerical analysis under the above-described conditions showed that the void fraction of the bubbles at the exit of the nozzle hole 3 in the structure shown in FIG. 10 is greater than that of the structure shown in FIG. 2 by approximately 0.1, indicating that a superior mixture state of gas and liquid has been achieved.

Figure 11:
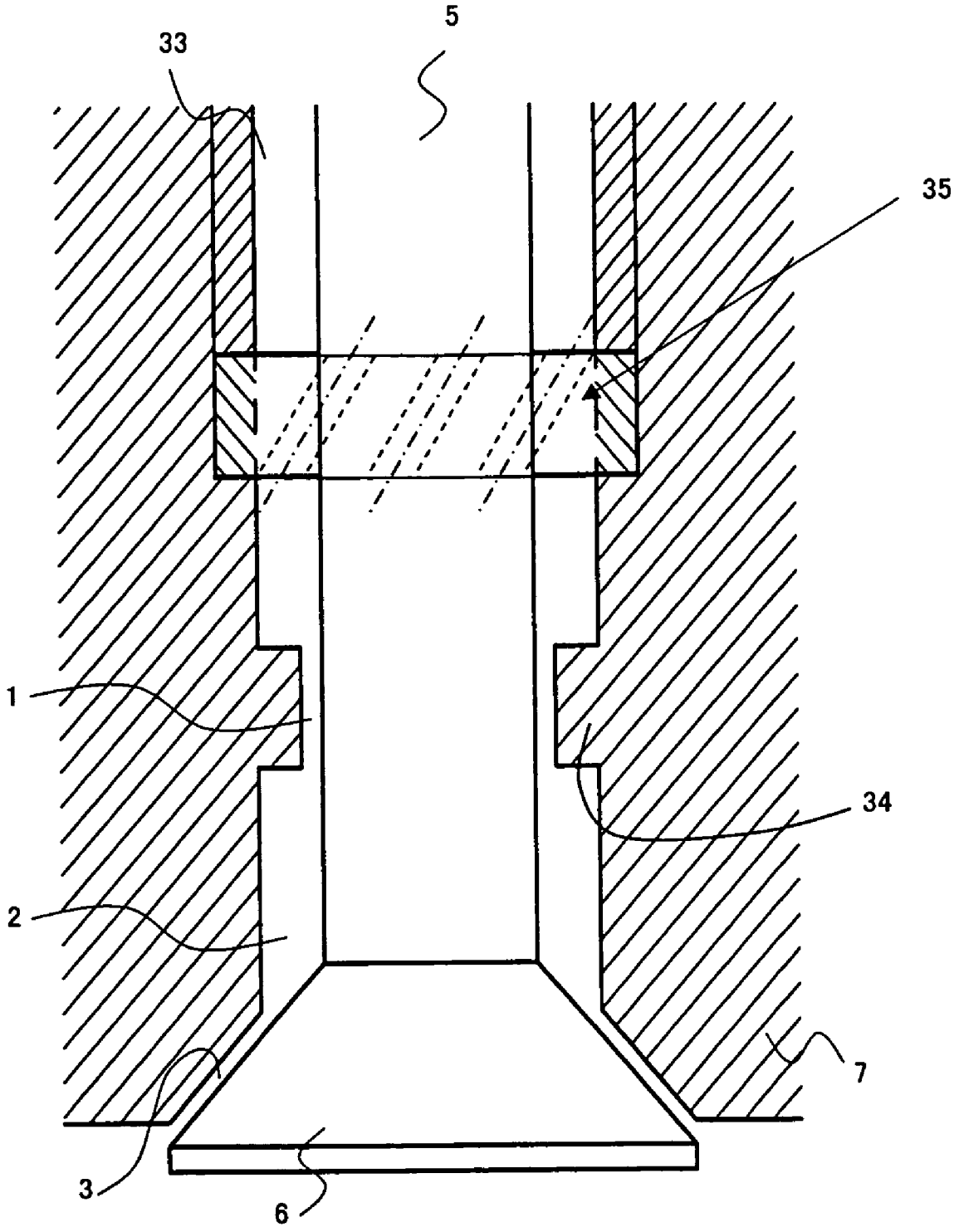
FIG. 11 is a diagram schematically showing another structure of a tip of a nozzle body.
Figure 12:
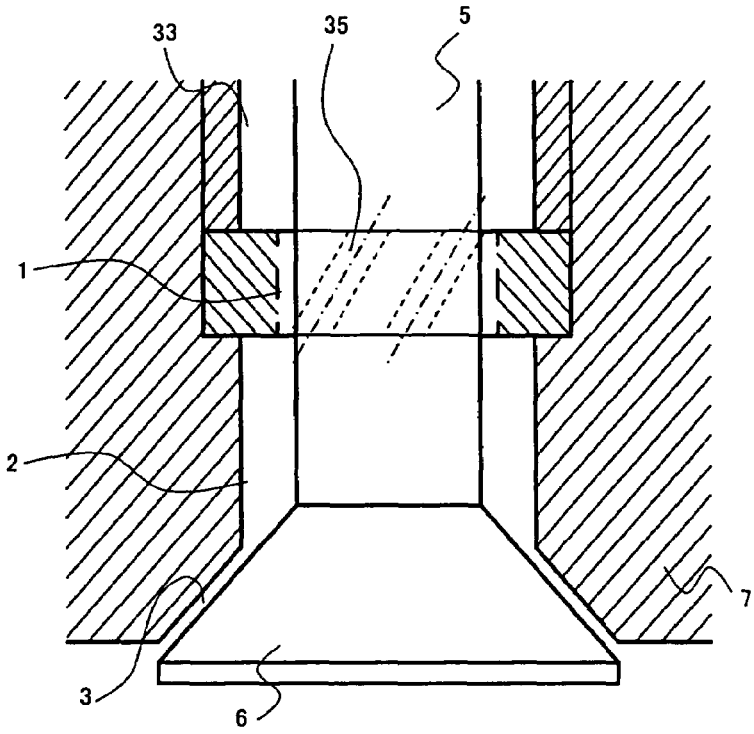
FIG. 12 is a diagram schematically showing another structure of a tip of a nozzle body.

In a configuration of the tip of the nozzle body as shown in FIG. 11, a swirler (swirl generation flow path) 35 which generates a swirl flow along a circumferential direction of the injection valve in the fuel flowing inside the injection valve is formed upstream of the cavitation generation flow path 1. In a configuration of the tip of the nozzle body as shown in FIG. 12, the swirler 35 is formed in the cavitation generation flow path 1. According to the structures shown in FIGS. 11 and 12, because a swirl flow along a circumferential direction of the injection valve can be generated in the fuel flow, non-uniformity in the flow rate distribution along the circumferential direction of the injection valve can be alleviated.

Figure 13:
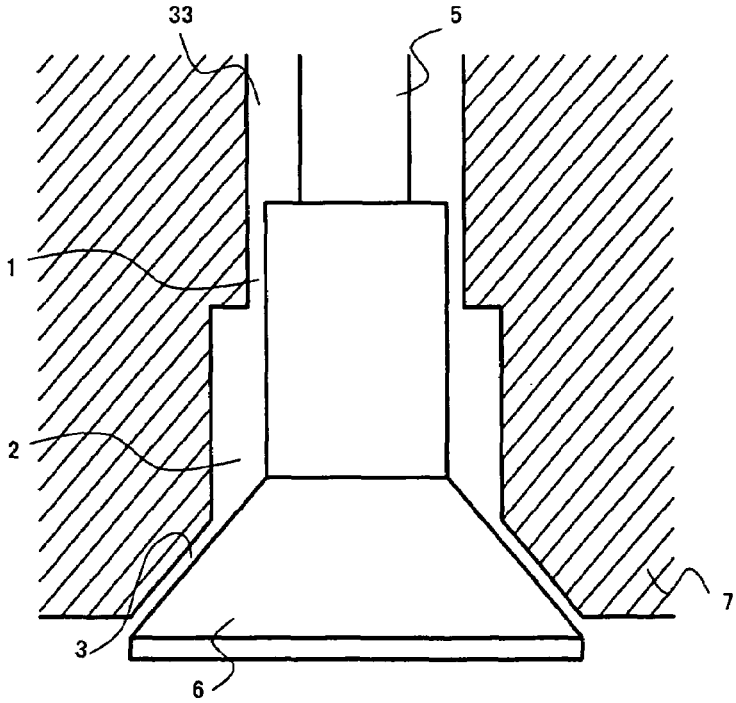
FIG. 13 is a diagram schematically showing another structure of a tip of a nozzle body.
Figure 14:
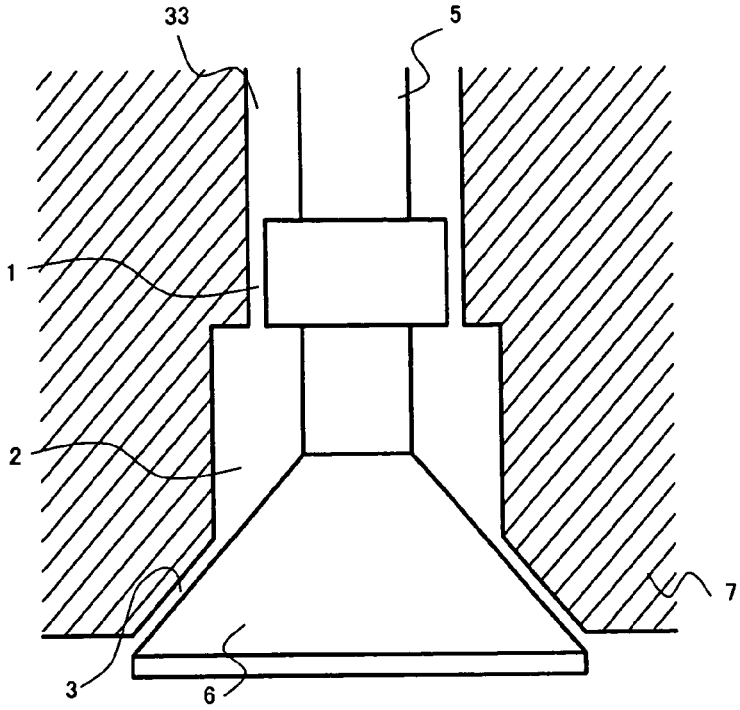
FIG. 14 is a diagram schematically showing another structure of a tip of a nozzle body.

In a configuration of the tip of the nozzle body as shown in FIG. 13, the radius of the pintle 5 is stepwise increased so that the cross sectional area of the flow path is rapidly reduced at the entrance of the cavitation generation flow path 1. In addition, the radius of a hollow portion of the nozzle body 7 is stepwise increased so that the cross sectional area of the flow path is rapidly expanded at the exit of the cavitation generation flow path 1. In a configuration of the tip of the nozzle body as shown in FIG. 14, in comparison to the configuration of FIG. 13, the radius of the hollow portion of the nozzle body 7 is stepwise increased and the radius of the pintle 5 is stepwise reduced so that the cross sectional area of the flow path is rapidly expanded at the exit of the cavitation generation flow path 1.

Figure 15:
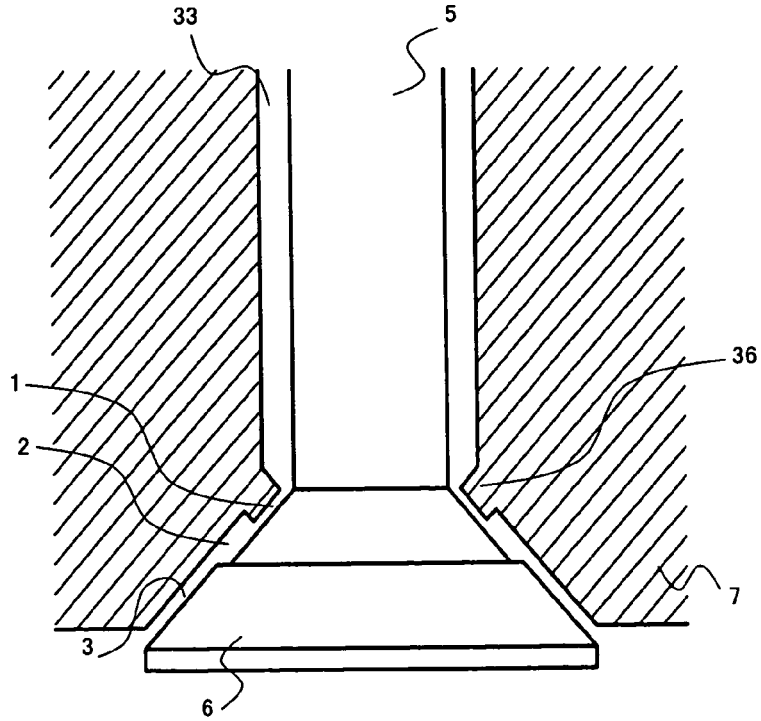
FIG. 15 is a diagram schematically showing another structure of a tip of a nozzle body.
Figure 16:
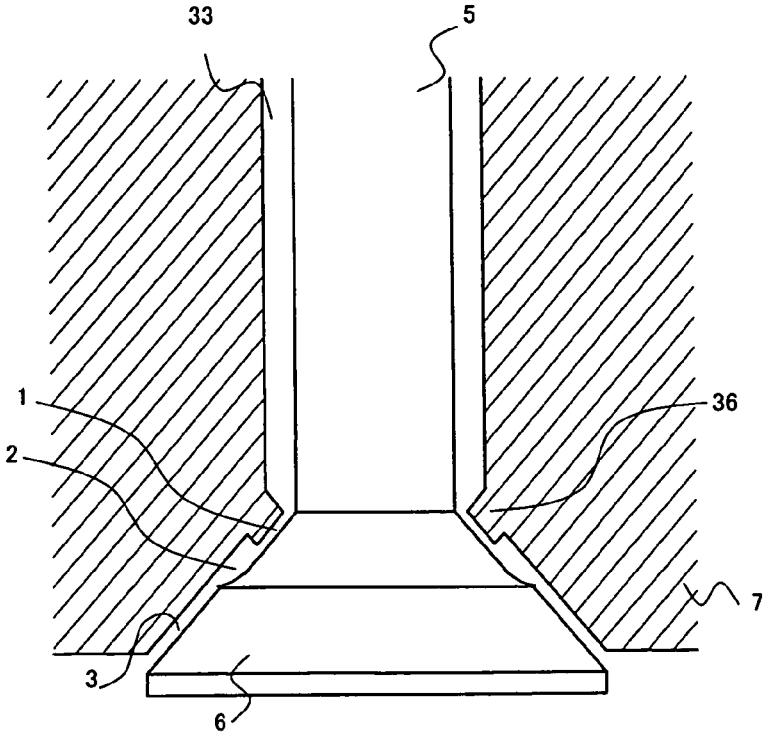
FIG. 16 is a diagram schematically showing another structure of a tip of a nozzle body.

In a configuration of the tip of the nozzle body as shown in FIG. 15, a projection 36 projecting toward the poppet valve 6 is formed at a position on the inner peripheral surface of the nozzle body 7 opposing the poppet valve 6 so that the cavitation generation flow path 1 is formed with the cross sectional area of the flow path rapidly reducing at the entrance and rapidly expanding at the exit. A step is formed in the poppet valve 6 to stepwise increase the radius of the poppet valve 6 so that the exit of the bubble storage flow path 2 is offset, with respect to the direction of the fuel jet flowing in the cavitation generation flow path 1, toward the external side along the radial direction of the injection valve. In a configuration of the tip of the nozzle body as shown in FIG. 16, in comparison to the configuration of FIG. 15, a slope having a curved surface shape is formed in the poppet valve 6 instead of formation of the step. With this structure, the shape of the wall of the bubble storage flow path 2 from a region approximately opposing the fuel jet flowing in the cavitation generation flow path 1 to the exit to the nozzle hole 3 can be set to a curved surface shape which is bowed toward the outside of the bubble storage flow path 2. According to the structure of FIG. 16, the direction of the fuel flow in the bubble storage flow path 2 can be smoothly changed so that liquefaction of the gas phase can be inhibited. In the structures of FIGS. 15 and 16, the direction of the fuel jet flowing in the nozzle hole 3 is approximately parallel to the direction of the fuel jet flowing in the cavitation generation flow path 1.

Figure 17:
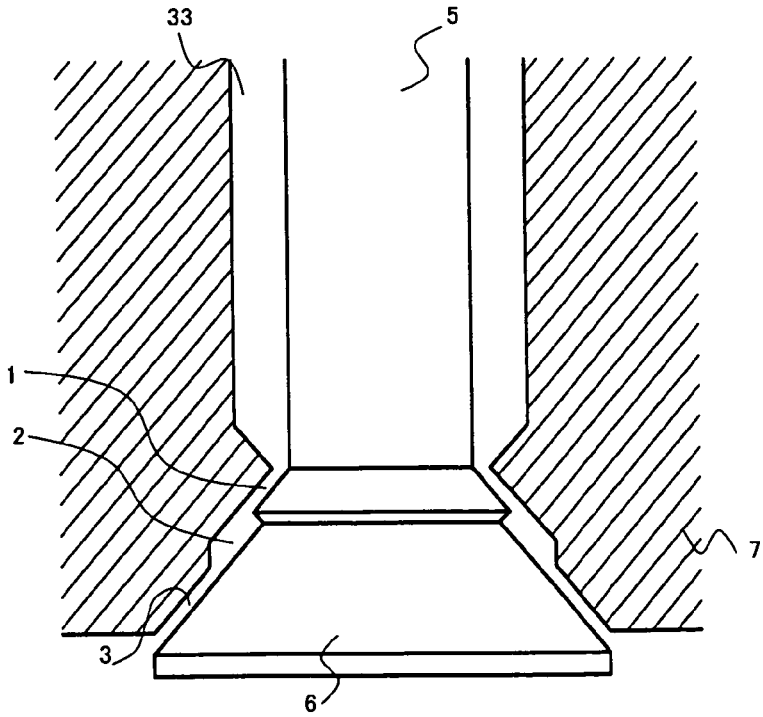
FIG. 17 is a diagram schematically showing another structure of a tip of a nozzle body.
Figure 18:
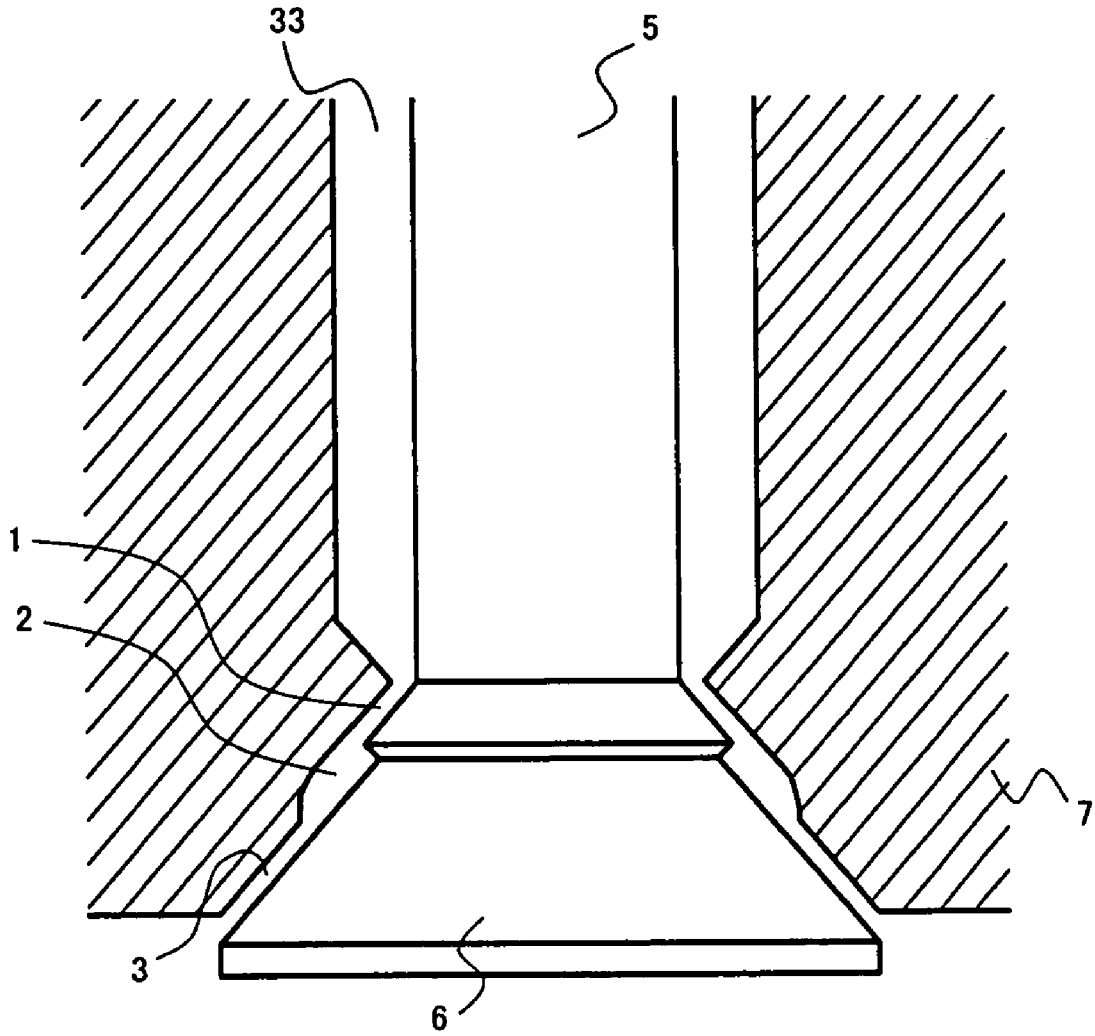
FIG. 18 is a diagram schematically showing another structure of a tip of a nozzle body.

In a configuration of the tip of the nozzle body as shown in FIG. 17, the radius of the poppet valve 6 is stepwise reduced so that the cross sectional area of the flow path at the exit of the cavitation generation flow path 1 is rapidly expanded toward the inside along the radial direction of the injection valve. In addition, by setting the inner peripheral surface of the nozzle body 7 to protrude toward the poppet valve 6, the exit of the bubble storage flow path 2 is offset, with respect to the direction of the fuel jet flowing in the cavitation generation flow path 1, toward the inside along the radial direction of the injection valve. In a configuration of the tip of the nozzle body as shown in FIG. 18, in comparison to the structure of FIG. 17, when the exit of the bubble storage flow path 2 is offset with respect to the direction of the fuel jet by setting the inner peripheral surface of the nozzle body 7 to protrude toward the poppet valve 6, a slope having a curved surface shape is formed at the inner peripheral surface of the nozzle body 7. Because of this structure, the shape of the wall which forms a part of the bubble storage flow path 2 contains a curved surface shape which is curved from a region approximately opposing the fuel jet flowing in the cavitation generation flow path 1 to the exit to the nozzle hole 3. With this structure of FIG. 18, the direction of the fuel flow in the bubble storage flow path 2 can be smoothly changed so that liquefaction of the gas phase can be inhibited. Regarding the bubble storage flow path 2 in the structures of FIGS. 17 and 18, while the entrance from the cavitation generation flow path 1 is placed at an outer peripheral side (side near the nozzle body 7), the exit to the nozzle hole 3 is placed at an inner peripheral side (side near the poppet valve 6).

In the above description, configurations have been described in which the present invention is applied to fuel injection valves of externally open valve type. The present invention, however, is not limited to such a configuration and can be applied to fuel injection valves of internally open valve type, as will be described below.

Figure 19A:
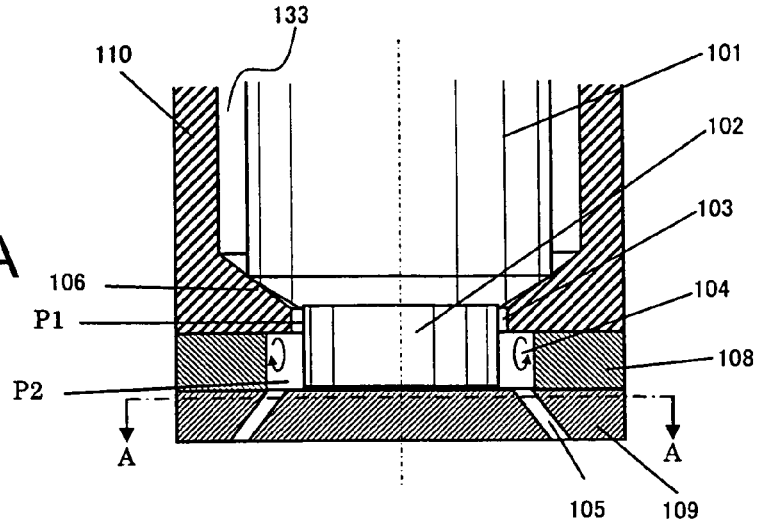
FIG. 19A is a diagram schematically showing another structure of a tip of a nozzle body.
Figure 19B:
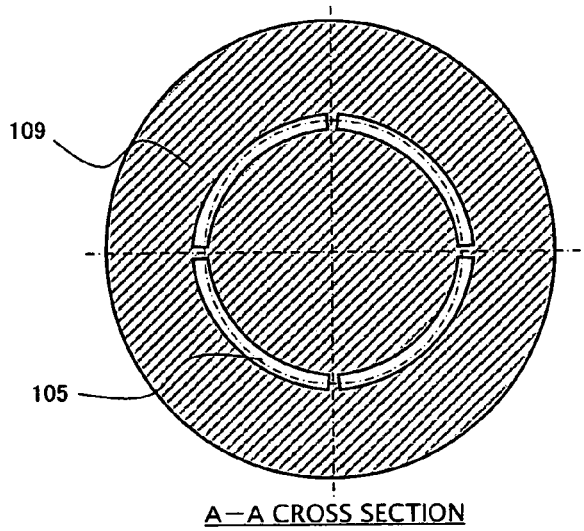
FIG. 19B is a diagram schematically showing another structure of a tip of a nozzle body.
Figure 19C:
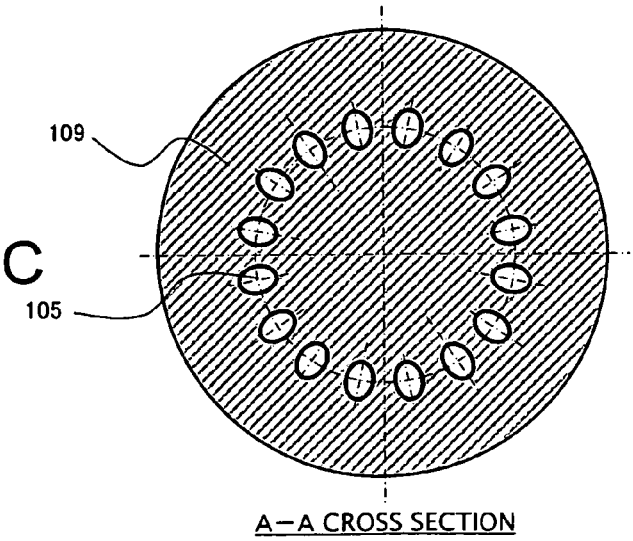
FIG. 19C is a diagram schematically showing another structure of a tip of a nozzle body.

FIGS. 19A, 19B, and 19C schematically show configurations when the present invention is applied to fuel injection valves of an internally open valve type. FIG. 19A is a diagram schematically showing an internal structure and FIGS. 19B and 19C are cross sectional diagrams schematically showing cross sections (A-A cross section of FIG. 19A) of a plate 109 in which a nozzle hole 105 is formed. A needle 101 is inserted in a hollow portion of a nozzle body 110 and is supported in a slidable manner along an internal peripheral surface of the nozzle body 110. The needle 101 can be driven by an electromagnetic actuator (not shown) and is in contact with a seat portion 106 of the nozzle body 110 when the fuel is not injected (when the electromagnetic actuator is not driven).

In the configuration shown in FIGS. 19A, 19B, and 19C, a cylindrical projection 102 is provided at a tip of the needle 101 and a ring-shaped gap is formed between the projection 102 and the nozzle body 110 so that a cavitation generation flow path 103 which generates cavitation bubbles in the fuel is formed downstream of the seat portion 106. In addition, a plate 108 in which a cylindrical hollow section is formed is attached to the tip of the nozzle body 110. The projection 102 at the tip of the needle 101 extends through the hollow section of the plate 108 and a ring-shaped gap is formed between the projection 102 and the plate 108 so that a bubble storage flow path 104 which stores the cavitation bubbles is formed downstream of the cavitation generation flow path 103. A cross sectional area of the bubble storage flow path 104 is rapidly expanded toward the outside along the radial direction of the injection valve from the cross sectional area of the cavitation generation flow path 103.

The plate 109 in which a nozzle hole 105 is formed is attached to the plate 108. The nozzle hole 105 is formed at a position connected to the bubble storage flow path 104 and an entrance of the nozzle hole 105 (exit of the bubble storage flow path 104) is formed at a position which is offset, with respect to the direction of the fuel jet flowing in the cavitation generation flow path 103, toward the outside along a radial direction of the injection valve. That is, regarding the bubble storage flow path 104, while the entrance from the cavitation generation flow path 103 is placed at an inner peripheral side (side near the needle 101), the exit to the nozzle hole 105 is placed at an outer peripheral side (side near the plate 108). Alternatively, the plates 108 and 109 may be integrated.

A shape of the nozzle hole 105 may be a shape of a plurality of slits arranged along the circumferential direction of the plate 109 as shown in FIG. 19B, or may be a shape of a plurality of circles arranged along the circumferential direction of the plate 109 as shown in FIG. 19C. As described, the shape of the nozzle hole 105 is not limited to a particular shape. A total value A2 of the cross sectional areas of the flow paths (minimum cross sectional area) of the plurality of nozzle holes 105 is set to be larger than the cross sectional area A1 (minimum cross sectional area) of the cavitation generation flow path 103. In addition, an angle of the nozzle hole 105 is set so that a direction of the fuel jet flowing in the nozzle hole 105 is tilted with respect to a direction of the fuel jet flowing in the cavitation generation flow path 103.

With the above-described structure, the cavitation generation flow path 103, bubble storage flow path 104, and nozzle hole 105 are formed downstream of the seat portion 106 of the nozzle body 110. Regarding other elements, the elements are substantially identical to the elements in the device of the externally open valve type, and therefore will not be described again.

An operation of the fuel injection valve having the structure of FIGS. 19A, 19B, and 19C will now be described.

When the fuel is injected, the needle 101 is driven by an electromagnetic actuator (not shown) so that the needle 101 is separated from the seat portion 106 of the nozzle body 110 and the fuel stored in the fuel storage portion 133 flows through the cavitation generation flow path 103 into the bubble storage flow path 104. When the injection starts, a pressure P2 of the bubble storage flow path 104 is equal to an environmental pressure Pa and a difference between a pressure P1 at the entrance of the cavitation generation flow path (pressure of fuel storage portion 133) and a pressure P2 at the exit of the cavitation generation flow path 103 (pressure of the bubble storage flow path 104) is maximum. Because of this, the cavitation number Cn defined by the formula (1) is at the maximum during start of the injection and cavitation bubbles can be easily generated in the cavitation generation flow path 103.

When the bubble storage flow path 104 is filled with fuel, cavitation bubbles are further generated at a shearing layer between the fuel jet to which cavitation bubbles are mixed and which exits from the exit of the cavitation generation flow path 103 and the fuel surrounding the fuel jet, similar to the case of the device of an externally open valve type as described above. A vertical vortex is formed within the bubble storage flow path 104 and cavitation bubbles are stored around a center of the vortex having a lower pressure than the surroundings. In addition, cavitation bubbles are also generated in the central part of the vertical vortex. The fuel liquid in the bubble storage flow path 104 and the cavitation bubbles are mixed and introduced to the nozzle hole 105, and fuel in a mixture state of gas and liquid is injected from the nozzle hole 105.

When, on the other hand, the bubble storage flow path 104 is not filled with fuel, the fuel to which cavitation bubbles exiting from the cavitation generation flow path 103 are mixed is injected from the nozzle hole 105 while the bubble storage flow path 104 is filled with the fuel. Then, when the bubble storage flow path 104 is approximately filled with the fuel, the device operates in a manner similar to the above-described operation when the bubble storage flow path 104 is filled with the fuel.

In the above-described operation, similar to the device of the externally open valve type, the pressure P1 of the fuel storage portion 133 (injection setting pressure) and the ratio A1/A2 of the cross sectional areas between the cavitation generation flow path 103 and the nozzle hole 105 are preferably set so that the cavitation number Cn calculated by the formula (1) is 1.7 or greater.

Similar to the above, in the fuel injection valve of the internally open valve type also, because the fuel can be injected from the nozzle hole 105 in a mixture state of gas and liquid, atomization enhancement effect of the fuel spray by collapse of cavitation can be effectively obtained over the entire region of the fuel jet after injection. In addition, the spray penetration force can be reduced without losing the atomization enhancement effect by the collapse of the cavitations, and consequently, occurrence of adhesion of the fuel on the wall can be reduced. Moreover, a strong vertical vortex can be formed in the bubble storage flow path 104, and it is possible to inhibit flow of the fuel jet from the cavitation generation flow path 103 to the nozzle hole 105 without any process.

Next, alternative configurations of the fuel injection valve of the internally open valve type will be described.

Figure 20A:
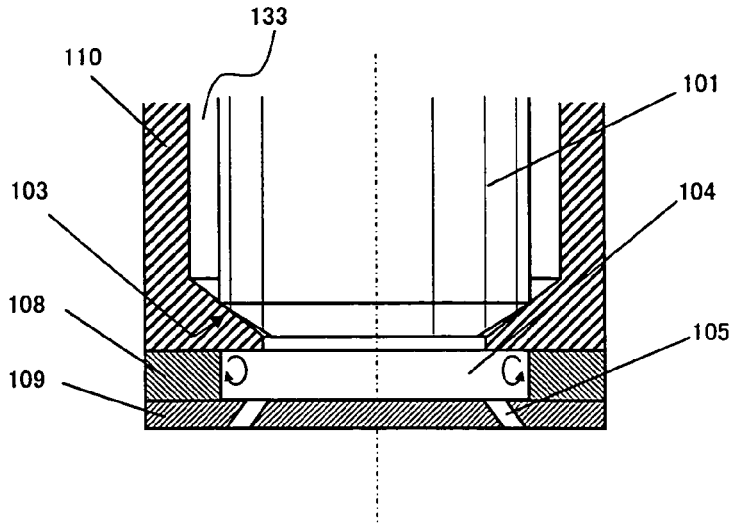
FIG. 20A is a diagram schematically showing another structure of a tip of a nozzle body.
Figure 20B:
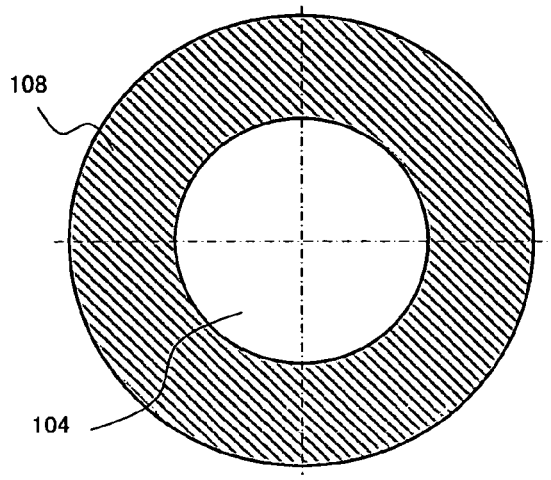
FIG. 20B is a diagram schematically showing another structure of a tip of a nozzle body.
Figure 20C:
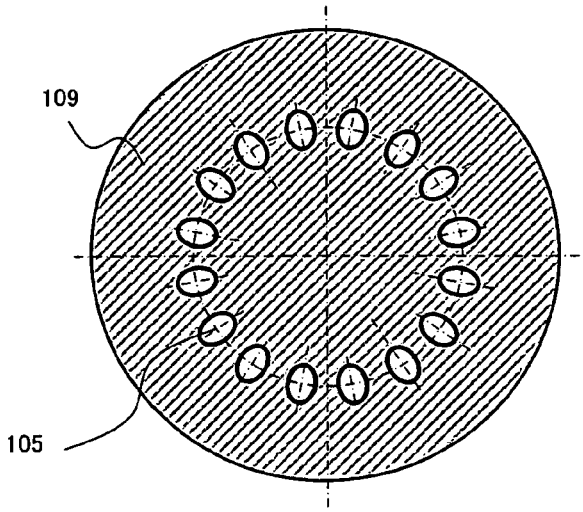
FIG. 20C is a diagram schematically showing another structure of a tip of a nozzle body.

In a configuration of the tip of the nozzle body shown in FIGS. 20A, 20B, and 20C, in comparison to the configuration of FIGS. 19A, 19B, and 19C, the projection 102 of the needle 101 is omitted. FIG. 20A is a diagram schematically showing an internal structure, FIG. 20B is a cross sectional diagram schematically showing a structure of the plate 108 in which the bubble storage flow path 104 is formed, and FIG. 20C is a cross sectional diagram schematically showing a structure of the plate 109 in which the nozzle hole 105 is formed. In the configuration shown in FIGS. 20A, 20B, and 20C, a flow path formed between the needle 101 and the seat portion 106 when the needle 101 is separated from the seat portion 106 functions as the cavitation generation flow path 103. In this case, the full-lift amount of the needle 101 is set so that a cross sectional area A1 (minimum cross sectional area) of the cavitation generation flow path 103 (flow path between the needle 101 and the seat portion 106) is smaller than a total value A2 of the cross sectional areas of the flow paths (minimum cross sectional area) of a plurality of nozzle holes 105 when the needle 101 is in the full-lift state. In addition, the full-lift amount of the needle 101 is preferably set so that the cavitation number Cn calculated using the formula (1) is 1.7 or greater.

Figure 21A:
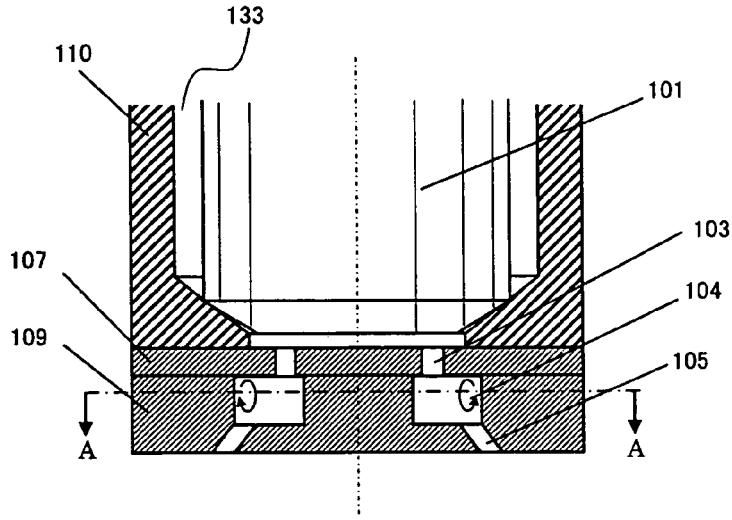
FIG. 21A is a diagram schematically showing another structure of a tip of a nozzle body.
Figure 21B:
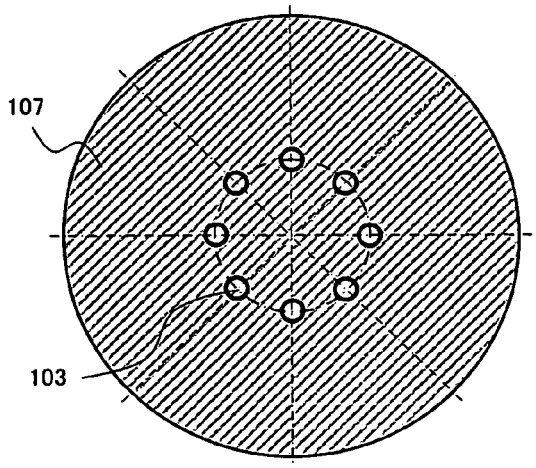
FIG. 21B is a diagram schematically showing another structure of a tip of a nozzle body.
Figure 21C:
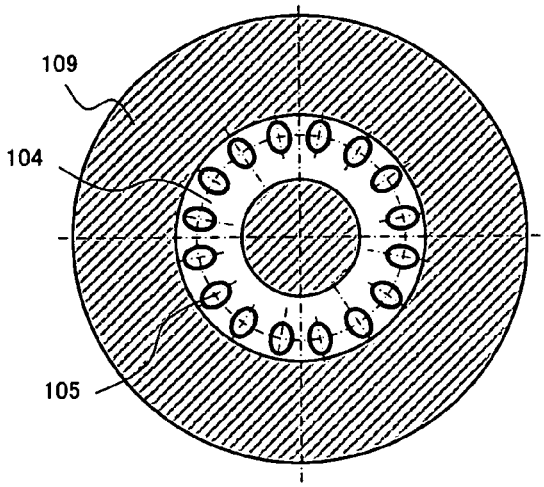
FIG. 21C is a diagram schematically showing another structure of a tip of a nozzle body.

In a configuration of the tip of the nozzle body shown in FIGS. 21A, 21B, and 21C, the plate 107 in which the cavitation generation flow path 103 is formed is attached to a tip of the nozzle body 110 and the plate 109 in which the bubble storage flow path 104 and the nozzle hole 105 are formed is attached to the plate 107. FIG. 21A is a diagram schematically showing an internal structure, FIG. 21B is a cross sectional diagram schematically showing a structure of the plate 107, and FIG. 21C is a cross sectional diagram (A-A cross section of FIG. 21A) schematically showing a structure of the plate 109. A plurality of cavitation generation flow paths 103 are placed along the circumferential direction of the plate 107. FIGS. 21A-21C show a configuration in which the cross sectional shape of the cavitation generation flow path 103 is circular, but the shape of the cavitation generation flow path 103 is not limited to this configuration. The bubble storage flow path 104 is formed by a ring-shaped channel formed in the plate 109 and a plurality of nozzle holes 105 which are connected to the bubble storage flow path 104 are placed along the circumferential direction of the plate 109. In this configuration, the entrance of each nozzle hole 105 (exit of the bubble storage flow path 104) is offset, with respect to the direction of the fuel jet flowing in each cavitation generation flow path 103, along the radial directions of the plates 107 and 109 (toward outside). Alternatively, it is also possible to offset, with respect to the direction of the fuel jet, the entrance of each nozzle hole 105 along the circumferential directions of the plates 107 and 109. A total value A2 of the cross sectional areas of the flow paths (minimum cross sectional area) of the plurality of nozzle holes 105 is set to be larger than a total value A1 of the cross sectional areas of the flow paths (minimum cross sectional area) of the plurality of cavitation generation flow paths 103. In addition, a pressure P1 of the fuel storage portion 133 (injection setting pressure) and the ratio A1/A2 of the cross sectional areas of the flow paths are preferably set so that the cavitation number Cn calculated by the formula (1) is 1.7 or greater. With the configuration of FIGS. 21A, 21B, and 21C, by forming the cavitation generation flow path 103 in the plate 107 which is a separate component from the nozzle body 110, the machining precision of the cavitation generation flow path 103 can be improved, and the machining cost can be reduced.

Figure 22:
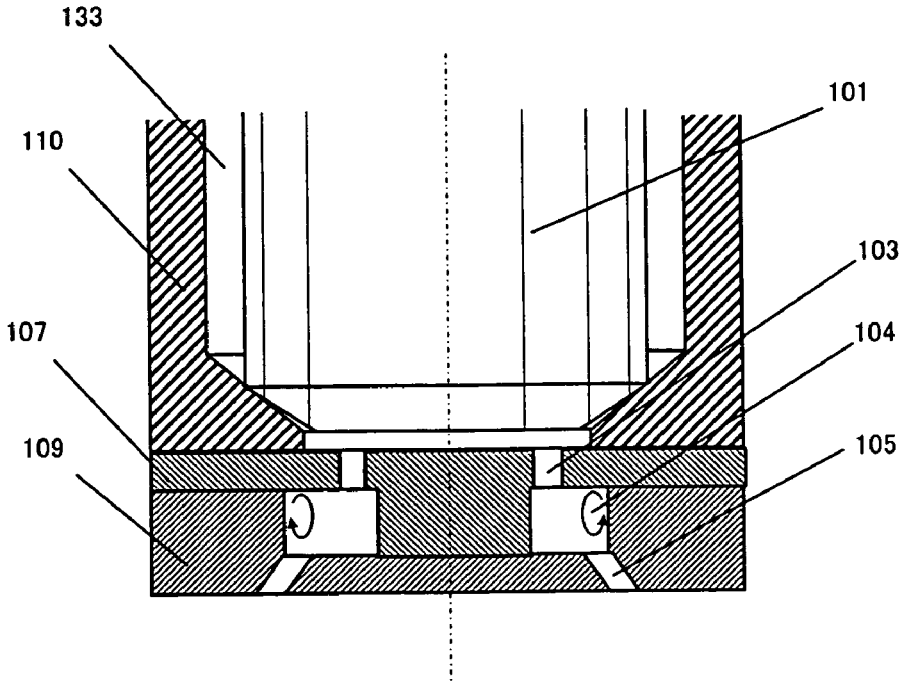
FIG. 22 is a diagram schematically showing another structure of a tip of a nozzle body.
Figure 23A:
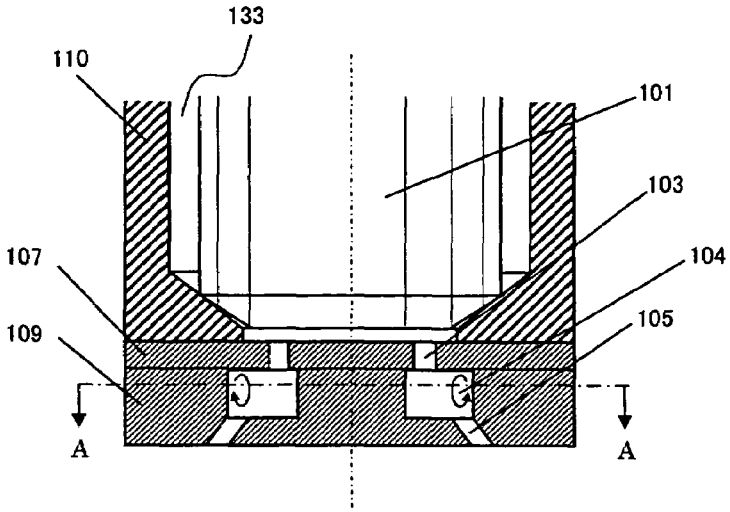
FIG. 23A is a diagram schematically showing another structure of a tip of a nozzle body.
Figure 23B:
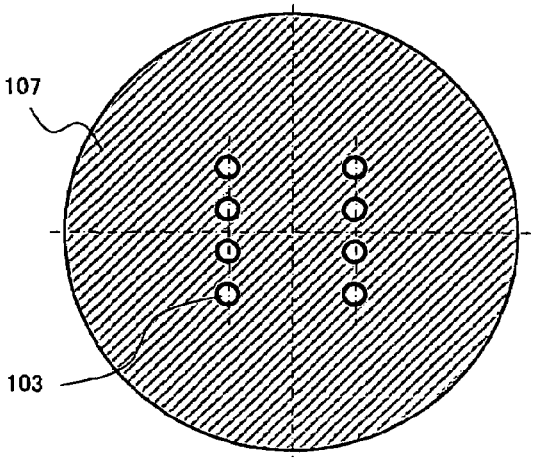
FIG. 23B is a diagram schematically showing another structure of a tip of a nozzle body.
Figure 23C:
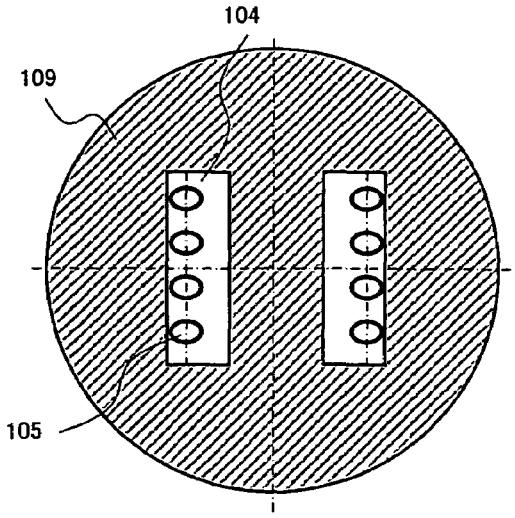
FIG. 23C is a diagram schematically showing another structure of a tip of a nozzle body.

In a configuration of the tip of the nozzle body as shown in FIG. 22, a ring-shaped bubble storage flow path 104 is formed by combining a concave plate 109 in which the central portion is depressed in a circular shape and a convex plate 107 on which a cylindrical projection is formed. In a configuration of the tip of the nozzle body as shown in FIGS. 23A, 23B, and 23C, a plurality of cavitation generation flow paths 103 are formed in the plate 107 in a linear manner and a plurality of nozzle holes 105 are formed on the plate 109 in a linear manner. FIG. 23A is a diagram schematically showing an internal structure, FIG. 23B is a cross sectional diagram schematically showing the structure of the plate 107, and FIG. 23C is a cross sectional diagram (A-A cross section of FIG. 23A) schematically showing the structure of the plate 109.

Figure 24A:
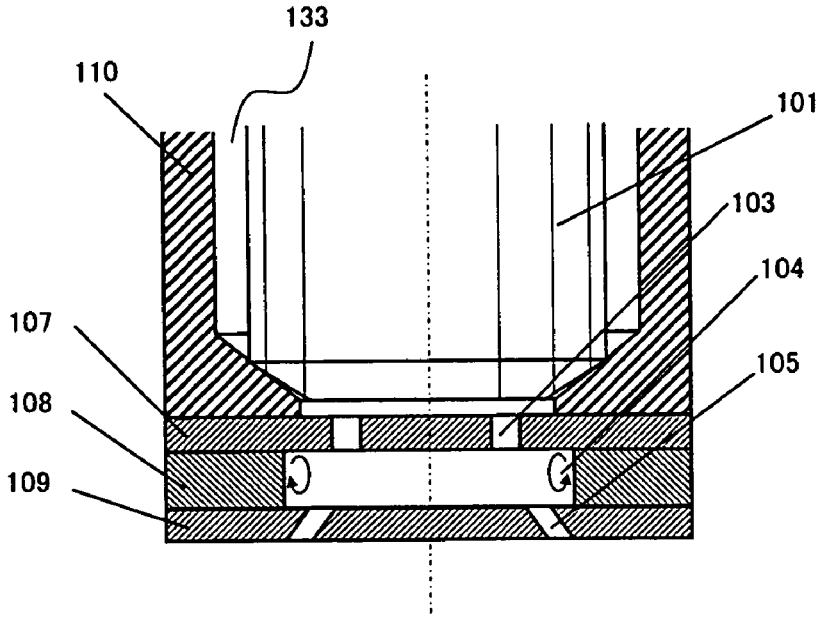
FIG. 24A is a diagram schematically showing another structure of a tip of a nozzle body.
Figure 24B:
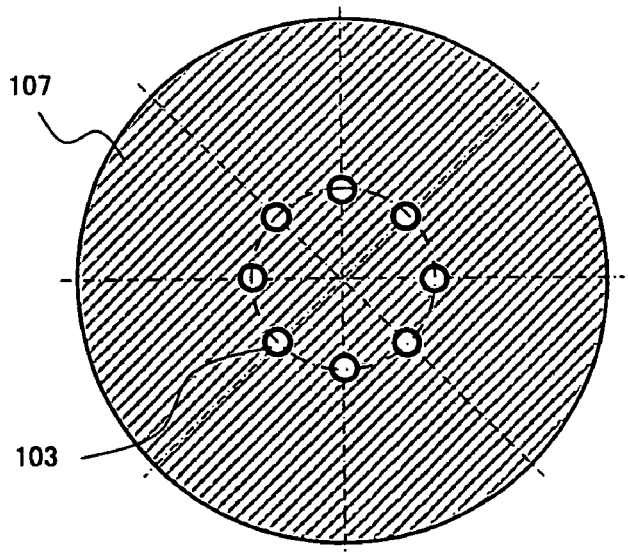
FIG. 24B is a diagram schematically showing another structure of a tip of a nozzle body.
Figure 24C:
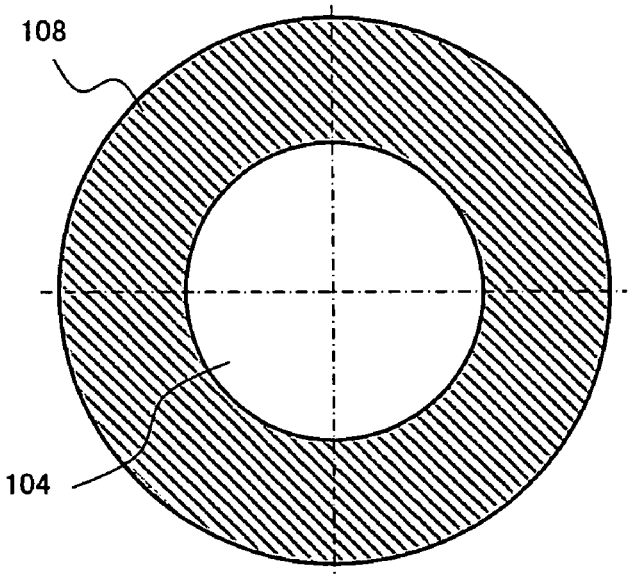
FIG. 24C is a diagram schematically showing another structure of a tip of a nozzle body.
Figure 24D:
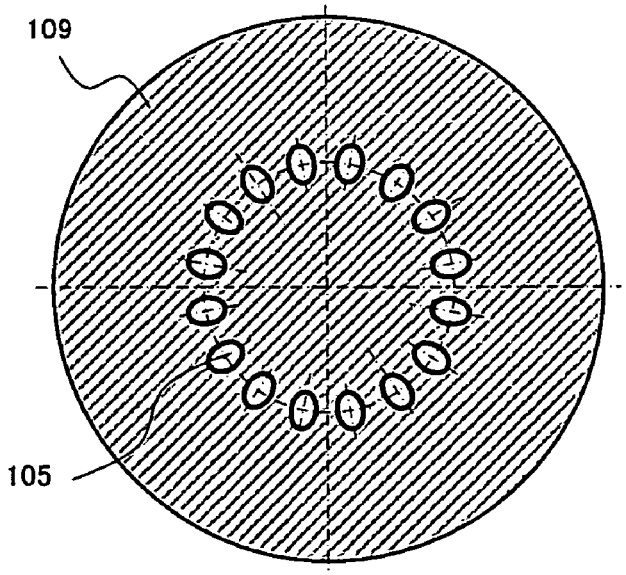
FIG. 24D is a diagram schematically showing another structure of a tip of a nozzle body.

In a configuration of the tip of the nozzle body as shown in FIGS. 24A, 24B, 24C, and 24D, in comparison to the configuration of FIGS. 20A, 20B, and 20C, the plate 107 in which the cavitation generation flow path 103 is formed is further provided between the nozzle body 110 and the plate 108. FIG. 24A is a diagram schematically showing an internal structure, FIG. 24B is a cross sectional diagram schematically showing the structure of the plate 107 in which the cavitation generation flow path 103 is formed, FIG. 24C is a cross sectional diagram schematically showing the structure of the plate 108 in which the bubble storage flow path 104 is formed, and FIG. 24D is a cross sectional diagram schematically showing the structure of the plate 109 in which the nozzle hole 105 is formed. FIGS. 24A and 24B show a case in which the structure of the plate 107 is similar to that of FIGS. 21A and 21B. However, the shape of the cavitation generation flow path 103 is not limited. With the structure of FIGS. 24A-24D, by employing a cylindrical shape as the shape of the bubble storage flow path 104, the machining cost of the bubble storage flow path 104 can be reduced.

Figure 25:
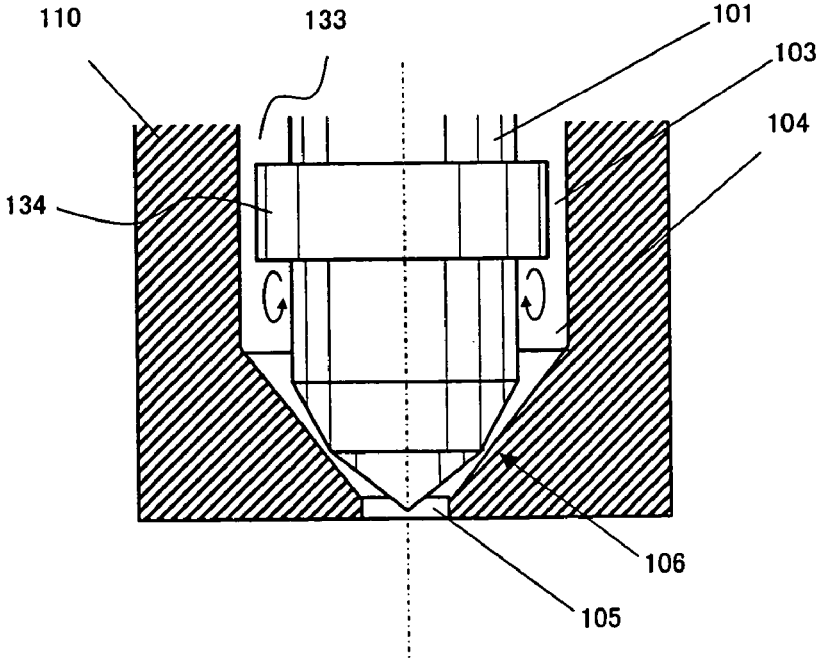
FIG. 25 is a diagram schematically showing another structure of a tip of a nozzle body.

In a configuration of the tip of the nozzle body as shown in FIG. 25, the cavitation generation flow path 103 and the bubble storage flow path 104 are formed upstream of the seat portion 106 of the nozzle body 110. In FIG. 25, a projection 134 projecting toward the nozzle body 110 is formed on the needle 101 so that a cavitation generation flow path 103 is formed in which the cross sectional area of the flow path is rapidly reduced at the entrance and is rapidly expanded at the exit. In the bubble storage flow path 104, while the entrance from the cavitation generation flow path 103 is placed at an outer periphery side (side near the nozzle body 110), the exit to the nozzle hole 105 is placed at an inner periphery side (side near the needle 101). The nozzle hole 105 is formed at the central portion of the tip of the nozzle body 110. In addition, the full-lift amount of the needle 101 is set so that the minimum cross sectional area A2 of the flow path from the seat portion 106 to the nozzle hole 105 is larger than the cross sectional area A1 (minimum cross sectional area) of the cavitation generation flow path 103 when the needle 101 is at the full-lift state. In addition, the full-lift amount of the needle 101 is preferably set so that the cavitation number Cn calculated by the formula (1) is 1.7 or greater.

Figure 26:
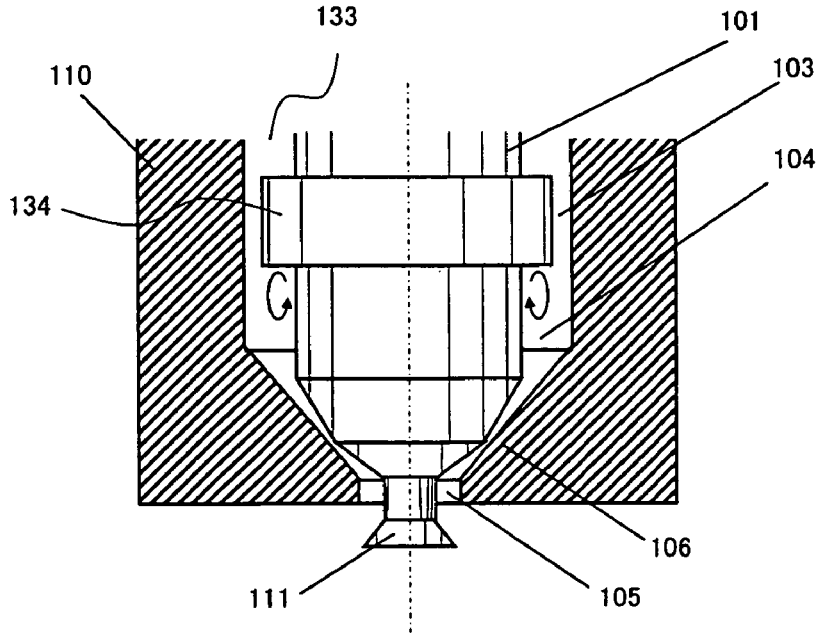
FIG. 26 is a diagram schematically showing another structure of a tip of a nozzle body.

In a configuration of the tip of the nozzle body as shown in FIG. 26, in comparison to the structure of FIG. 25, a cone-shaped projection 111 is provided at the tip (downstream of the exit of the nozzle hole 105) of the needle 101. With the structure of FIG. 26, the fuel injected from the nozzle hole 105 (in a mixed state of gas and liquid) expands in a conical shape along the conically shaped projection 111, and thus, a widely spread spay having an approximate hollow conical shape can be formed.

Figure 27:
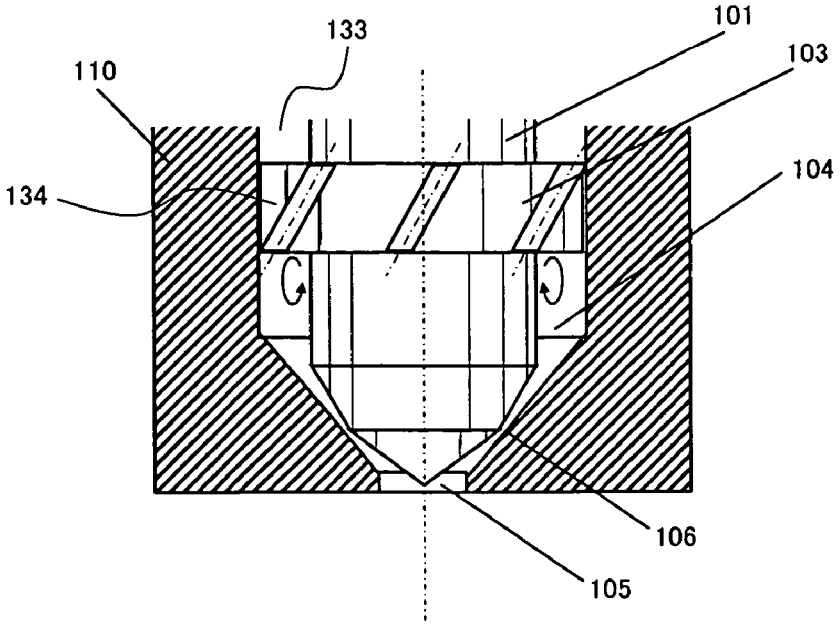
FIG. 27 is a diagram schematically showing another structure of a tip of a nozzle body.

In a configuration of the tip of the nozzle body shown in FIG. 27, in comparison with the structure of FIG. 25, a plurality of channels which are tilted with respect to an axis of the needle 101 are formed in the projection 134 so that a swirler (swirl generation flow path) which generates a swirl flow along a circumferential direction of the injection valve in the fuel flowing inside the injection valve is formed in the cavitation generation flow path 103. With the structure of FIG. 27, a swirl flow is formed in the bubble storage flow path 104 and fuel having a swirl velocity component is injected from the nozzle hole 105. The injected spray expands along the radial direction due to the centrifugal force and a widely spread spray having an approximate hollow conical shape can be formed.

In the configurations of FIGS. 19A-27, similar to the device of an externally open valve type as described above, the discharge coefficient of the cavitation generation flow path 103 can be increased by gradually reducing the cross sectional area of the flow path at the entrance of the cavitation generation flow path 103 toward the bubble storage flow path 104. Alternatively, the discharge coefficient of the cavitation generation flow path 103 can be increased by employing a tapered shape for the cavitation generation flow path 103 to set the cross sectional area of the flow path of the cavitation generation flow path 103 to become smaller toward the bubble storage flow path 104. Moreover, the shape of the wall of the bubble storage flow path 104 may be set to contain a curved shape which is curved from a region which approximately opposes the fuel jet flowing in the cavitation generation flow path 103 to the exit to the nozzle hole 105 so that the direction of the fuel flow in the bubble storage flow path 104 changes smoothly and the liquefaction of the gas phase is inhibited.

A preferred embodiment of the present invention has been described. The description of the preferred embodiment, however, should not be construed as limiting the present invention and various modifications can be made within the scope of the present invention.

What is claimed is:

1. A fuel injection valve which injects fuel from a nozzle hole, the fuel injection valve comprising:

a cavitation generation flow path in which a cavitation bubble is generated in fuel flowing inside the injection valve;

a nozzle hole disposed downstream of the cavitation generation flow path at an outermost portion of a flow path formed within the fuel injection valve along the direction of flow; and a bubble storage flow path which is connected to the cavitation generation flow path and the nozzle hole and which stores the cavitation bubble generated in the cavitation generation flow path, wherein a flow path is rapidly expanded in transition from the cavitation generation flow path to the bubble storage flow path, the bubble storage flow path, in which a wall bordering the bubble storage flow path is provided to oppose a direction of a fuel jet flowing in the cavitation generation flow path, is directly connected to the cavitation generation flow path and the nozzle hole in a state where an exit to the nozzle hole is offset in the same direction as the flow path is rapidly expanded in a transition from the cavitation generation flow path to the bubble storage flow path with respect to a direction of a fuel jet flowing in the cavitation generation flow path, and the fuel injection valve injects, from the nozzle hole, fuel containing the cavitation bubble stored in the bubble storage flow path in a state wherein the cavitation generation flow path has a flow path area which is smallest in the flow path from the cavitation generation flow path to the nozzle hole.

2. A fuel injection valve according to claim 1, wherein the fuel injection valve injects the fuel from the nozzle hole while a cross sectional area of the bubble storage flow path is larger than a cross sectional area of the cavitation generation flow path.

3. A fuel injection valve according to claim 1, wherein a cross sectional area of an entrance portion of the cavitation generation flow path is gradually reduced toward the bubble storage flow path.

4. A fuel injection valve according to claim 1, wherein a cross sectional area of the cavitation generation flow path is reduced toward the bubble storage flow path.

5. A fuel injection valve according to claim 1, wherein the fuel injection valve has a wall which forms a part of the bubble storage flow path;

the exit which connects the bubble storage flow path and the nozzle hole is provided in the bubble storage flow path, and the wall has a curved surface which curves from a region which approximately opposes a fuel jet flowing in the cavitation generation flow path to the exit to the nozzle hole.

6. A fuel injection valve according to claim 1, wherein a swirl generation flow path in which a swirl flow is generated in fuel flowing inside the injection valve is formed upstream of the cavitation generation flow path.

7. A fuel injection valve according to claim 1, wherein a swirl generation flow path in which a swirl flow is generated in fuel flowing inside the injection valve is formed in the cavitation generation flow path.

8. A fuel injection valve according to claim 1, wherein a point where the flow path is rapidly expanded comprises, in cross-section, a vertex of two linear segments.

9. A fuel injection valve according to claim 8, wherein the two linear segments intersect at a right angle.

10. A fuel injection valve according to claim 8, wherein one of the linear segments is disposed perpendicular to the fuel jet flowing in the cavitation generation flow path.

* * * * *

UNITED STATES PATENT AND TRADEMARK OFFICE

CERTIFICATE OF CORRECTION

PATENT NO. : 7,712,684 B2
APPLICATION NO. : 11/300365
DATED : May 11, 2010
INVENTOR(S) : Ryo Masuda et al.

It is certified that error appears in the above-identified patent and that said Letters Patent is hereby corrected as shown below:

Title page, Item (30), line 2, "2001-368558" should read --2004-368558--.

Signed and Sealed this

Fourteenth Day of September, 2010

David J. Kappos

David J. Kappos
*Director of the United States Patent and Trademark Office*